US012655562B2

(12) United States Patent
Funakoshi et al.

(10) Patent No.: US 12,655,562 B2
(45) Date of Patent: Jun. 16, 2026

(54) WASHING MACHINE

(71) Applicant: SAMSUNG ELECTRONICS CO., LTD., Suwon-si (KR)

(72) Inventors: Hidekazu Funakoshi, Yokohama (JP); Osamu Kazama, Yokohama (JP); Hiroshi Katsumoto, Yokohama (JP); Yasuyuki Sonoda, Yokohama (JP)

(73) Assignee: SAMSUNG ELECTRONICS CO., LTD., Gyeonggi-Do (KR)

( * ) Notice: Subject to any disclaimer, the term of this patent is extended or adjusted under 35 U.S.C. 154(b) by 171 days.

(21) Appl. No.: 18/786,605

(22) Filed: Jul. 29, 2024

(65) Prior Publication Data

US 2024/0384457 A1 Nov. 21, 2024

Related U.S. Application Data

(63) Continuation of application No. PCT/KR2023/001663, filed on Feb. 6, 2023.

(30) Foreign Application Priority Data

Mar. 31, 2022 (JP) ..... 2022-058178

(51) Int. Cl.
*D06F 33/40* (2020.01)
*D06F 33/42* (2020.01)
(Continued)

(52) U.S. Cl.
CPC ..... *D06F 33/40* (2020.02); *D06F 33/42* (2020.02); *D06F 33/44* (2020.02); *D06F 37/304* (2013.01); *D06F 2101/04* (2020.02)

(58) Field of Classification Search
None
See application file for complete search history.

(56) References Cited

U.S. PATENT DOCUMENTS 5,824,114 A 10/1998 Pyo
5,887,458 A 3/1999 Bae
(Continued)

FOREIGN PATENT DOCUMENTS

JP 587268 A 4/1993
JP 2006204428 A 8/2006
(Continued)

OTHER PUBLICATIONS

International Search Report mailed Apr. 27, 2023 for PCT/KR2023/001663, citing the above reference(s).

*Primary Examiner* — Rita P Adhlakha
(74) *Attorney, Agent, or Firm* — CANTOR COLBURN LLP

(57) ABSTRACT

A washing machine includes a controller for controlling a series of washing processes. In a first process, the controller sets a clutch to a first mode in which a rotation of a motor is transferred to a rotating tub via a reducer, and controls the motor to allow the rotation tube to rotate with a first rotation speed which is greater than or equal to a certain rotation speed set to generate a centrifugal force to make laundry stuck to an internal wall of the rotating tub. In a second process after the first process, the controller sets the clutch to a second mode in which the rotation of the motor is transferred to the rotating tub without being through the reducer, and controls the motor to allow the rotating tub to rotate with a second rotation speed which is greater than the first rotation speed.

15 Claims, 21 Drawing Sheets

(51) Int. Cl.

| | |
|---|---|
| ***D06F 33/44*** | (2020.01) |
| ***D06F 37/30*** | (2020.01) |
| ***D06F 101/04*** | (2020.01) |

(56) References Cited

U.S. PATENT DOCUMENTS

| | | | | |
|---|---|---|---|---|
| 8,122,549 | B2 | 2/2012 | Park et al. | |
| 10,214,846 | B2 | 2/2019 | Song | |
| 11,180,883 | B2 | 11/2021 | Kim et al. | |
| 11,365,504 | B2 | 6/2022 | Sonoda et al. | |
| 11,434,596 | B2 | 9/2022 | Ohyagi et al. | |
| 2020/0232143 | A1* | 7/2020 | Sonoda | D06F 33/00 |

FOREIGN PATENT DOCUMENTS

| | | | |
|---|---|---|---|
| JP | 4674601 | B2 | 4/2011 |
| JP | 2011229554 | A | 11/2011 |
| JP | 2012254246 | A | 12/2012 |
| JP | 2013059440 | A | 4/2013 |
| JP | 2013085686 | A | 5/2013 |
| JP | 5897282 | B2 | 3/2016 |
| JP | 2020124381 | A | 8/2020 |
| KR | 100408787 | B1 | 12/2003 |
| KR | 101139254 | B1 | 5/2012 |
| KR | 20130077992 | A | 7/2013 |
| KR | 20180074375 | A | 7/2018 |
| KR | 20210061929 | A | 5/2021 |
| WO | 2016122170 | A1 | 8/2016 |

* cited by examiner

WASHING MACHINE

This application is a continuation application of International Application No. PCT/KR2023/001663, designating the United States, filed on Feb. 6, 2023, in the Korean Intellectual Property Receiving Office and claiming priority to Japanese Patent Application No. 2022-058178, filed on Mar. 31, 2022 in the Japanese Intellectual Property Office, the disclosures of which are incorporated by reference herein in their entireties.

BACKGROUND

(1) Field

The disclosure relates to a washing machine.

(2) Description of the Related Art

Japanese Laid-open Patent Publication No. 2020-124381 discloses a washing machine including a driving unit for driving a drum. The driving unit includes a shaft, a motor rotating the shaft, a clutch disposed between the shaft and the motor, and a reducer using a planetary gear mechanism. The clutch is configured to switch between a first mode in which the motor rotates the shaft with the reducer provided therebetween, and a second mode in which the motor rotates the shaft without using the reducer provided therebetween. In the washing machine, the clutch is switched to the second mode during a dewatering process so that the drum may be effectively rotated at high speed.

SUMMARY

A washing machine according to an embodiment of the disclosure includes a fixed tub, a rotating tub, a drain mechanism, a driving unit, and a controller. In such an embodiment, the rotating tub is rotatably accommodated in the fixed tub, and Laundry is inserted into the rotating tub. In such an embodiment, the drain mechanism drains water collected in the fixed tub. In such an embodiment, the driving unit includes a clutch switchable to a first mode and a second mode. In such an embodiment, the first mode is a mode in which a rotational force of the motor is transferred to the rotating tub via a reducer, and the second mode is a mode in which the rotating force of the motor is transferred to the rotating tub without being through the reducer. In such an embodiment, the controller includes a processor configured to control a driving operation of the washing machine. In such an embodiment, the driving operation includes a first process, and a second process including a dewatering process. In such an embodiment, the controller sets the clutch to the first mode, in the first process, and controls the motor in a way such that a rotation speed of the rotating tub is at a first rotation speed. In such an embodiment, the first rotation speed is greater than or equal to a certain rotation speed set to generate a centrifugal force to make the laundry stuck to an inner wall of the rotating tub due to a centrifugal force. In such an embodiment, the controller controls, in the second process, the drainage mechanism in a way such that the water collected in the fixed tub is discharged, set the clutch to the second mode, and controls the motor in a way such that the rotation speed of the rotating tub is a second rotation speed. In such an embodiment, the second rotation speed is greater than the first rotation speed.

DETAILED DESCRIPTION

Figure 1:
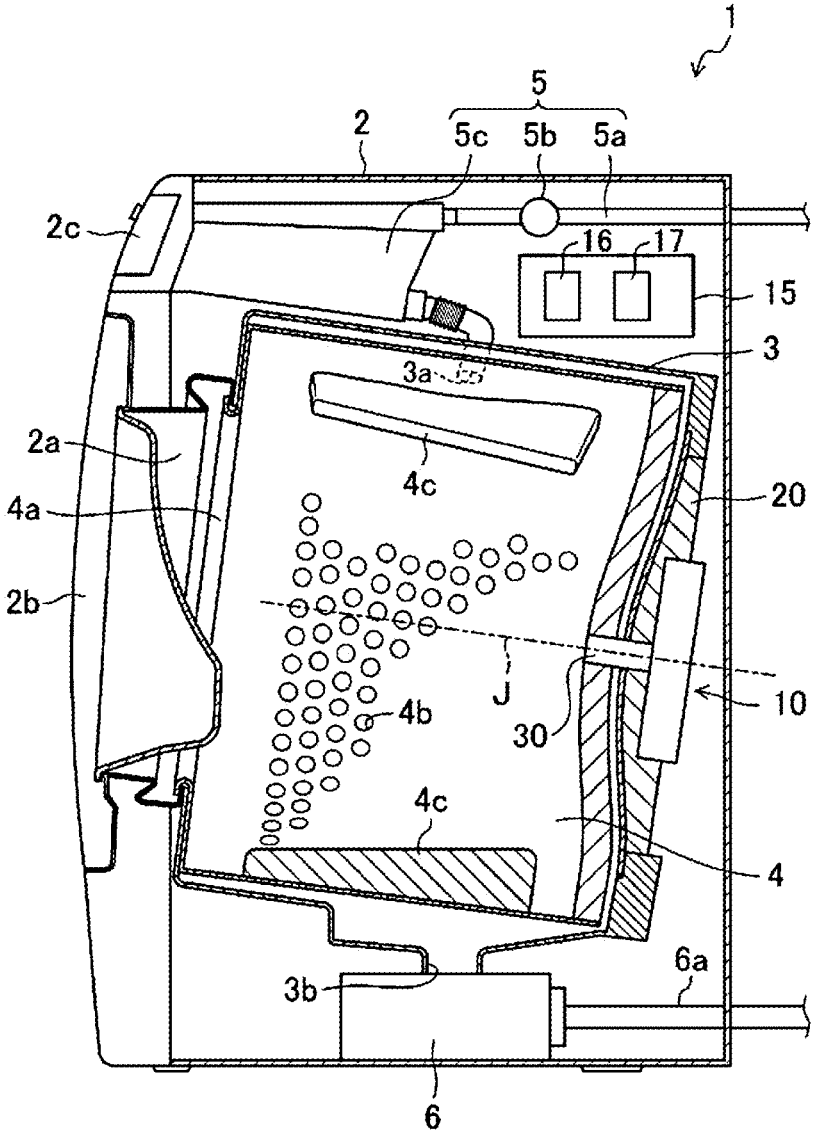
FIG. 1 is a schematic block diagram of a washing machine according to an embodiment of the disclosure.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terminology used herein is for the purpose of describing particular embodiments only and is not intended to be limiting. As used herein, "a", "an," "the," and "at least one" do not denote a limitation of quantity, and are intended to include both the singular and plural, unless the context clearly indicates otherwise. Thus, reference to "an" element in a claim followed by reference to "the" element is inclusive of one element and a plurality of the elements. For example, "an element" has the same meaning as "at least one element," unless the context clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

As used herein, each of such phrases as "A or B," "at least one selected from A and B," "at least one of A or B," "A, B, or C," "at least one selected from A, B, and C," and "at least one of A, B, or C," may include any one of, or all possible combinations of the items enumerated together in a corresponding one of the phrases.

The term "and/or" includes a combination of a plurality of related described components or any one component among the plurality of related described components.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., by wire), wirelessly, or via a third element.

When a component is referred to as being "connected to", "combined with", "supported by", or "in contact with" another component, this includes not only a case where the components are connected to, combined with, supported by, or in contact with each other in a direct manner, but also a case where the components are connected to, combined with, supported by, or in contact with each other in an indirect manner via a third component.

When a component is referred to as being positioned "on" another component, this includes not only a case where a component is in contact with another component, but also a case where another component exists between the two components.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

A washing machine according to various embodiments may perform washing, rinsing, dewatering, and drying processes. The washing machine is an example of a laundry treatment device, and the laundry treatment device is a concept encompassing a device for washing laundry (objects to be washed and objects to be dried), a device for drying laundry, and a device capable of washing and drying laundry.

The washing machine according to various embodiments may include a top-loading washing machine in which a laundry inlet for loading laundry into the washing machine or taking out the laundry from the washing machine is provided to face upward, or a front-loading washing machine in which a laundry inlet is provided to face forward. The washing machine according to various embodiments may include a washing machine in another loading type as well as the top-loading washing machine and the front-loading washing machine.

The top-loading washing machine is capable of washing laundry using a water flow generated by a rotating body such as a pulsator. The front-loading washing machine is capable of washing laundry by rotating a drum to repeatedly raise and drop laundry. The front-loading washing machine may include a dryer-combined washing machine capable of drying laundry accommodated in a drum. The dryer-combined washing machine may include a hot air supply device for supplying high-temperature air into the drum and a condensing device for removing moisture in the air discharged from the drum. As an example, the dryer-combined washing machine may include a heat pump device. The washing machine according to various embodiments may include a washing machine using a washing method other than the above-described washing method.

The washing machine according to various embodiments may include a housing accommodating various components therein. The housing may be provided in the form of a box in which a laundry inlet is formed on one side thereof.

The washing machine may include a door for opening and closing the laundry inlet. The door may be mounted on the housing to be rotatable by means of a hinge. At least a partial portion of the door may be transparent or translucent so that the inside of the housing is visible.

The washing machine may include a tub provided inside the housing to store water. The tub may be provided in a substantially cylindrical shape with a tub opening formed on one side thereof, and disposed inside the housing in such a manner that the tub opening corresponds to the laundry inlet.

The tub may be connected to the housing by a damper. The damper may absorb vibration generated while the drum is rotating to dampen vibration to be transmitted to the housing.

The washing machine may include a drum provided to accommodate laundry.

The drum may be disposed inside the tub in such a manner that a drum opening provided on one side thereof corresponds to the laundry inlet and the tub opening. The laundry may be accommodated in the drum or may be taken out of the drum by passing through the laundry inlet, the tub opening, and the drum opening sequentially.

The drum may perform an operation corresponding to a washing, rinsing, and/or dewatering process while rotating inside the tub. A plurality of through holes may be defined or formed in a cylindrical wall of the drum to allow water stored in the tub to flow into or out of the drum.

The washing machine may include a driving device configured to rotate the drum. The driving device may include a driving motor and a rotating shaft for transmitting a driving force generated by the driving motor to the drum. The rotating shaft may pass through the tub and be connected to the drum.

The driving device may perform an operation corresponding to a washing, rinsing, dewatering, and/or drying process by rotating the drum forward or backward.

The washing machine may include a water supply device configured to supply water to the tub. The water supply device may include a water supply pipe and a water supply valve provided at the water supply pipe. The water supply pipe may be connected to an external water supply source. The water supply pipe may extend from the external water supply source to a detergent supply device and/or the tub. Water may be supplied to the tub through the detergent supply device. Water may be supplied to the tub without being through the detergent supply device.

The water supply valve may open or close the water supply pipe in response to an electrical signal from a control unit. The water supply valve may allow or block the supply of water from the external water supply source to the tub. The water supply valve may include, for example, a solenoid valve opened and closed in response to an electrical signal.

The washing machine may include a detergent supply device configured to supply detergent to the tub. The detergent supply device may include a manual detergent supply device that requires a user to input detergent to be used every time for washing, or an automatic detergent supply device that stores a large amount of detergent and automatically inputs a predetermined amount of detergent during washing. The detergent supply device may include a detergent box for storing detergent. The detergent supply device may be configured to supply detergent into the tub during a water supply process. Water supplied through the water supply pipe may be mixed with the detergent via the detergent supply device. The water mixed with the detergent may be supplied into the tub. The detergent is used as a term encompassing pre-washing detergent, main-washing detergent, fabric softener, bleach, etc., and the detergent box may be partitioned into an area for storing the pre-washing detergent, an area for storing the main-washing detergent, an area for storing the fabric softener, and an area for storing the bleach.

The washing machine may include a drain device configured to discharge water accommodated in the tub to the outside. The drain device may include a drain pipe extending from the bottom of the tub to the outside of the housing, a drain valve provided at the drain pipe to open and close the drain pipe, and a pump provided on the drain pipe. The pump may pump water in the drain pipe out of the housing.

The washing machine may include a control panel disposed on one side surface of the housing. The control panel may provide a user interface for interaction between the user and the washing machine. The user interface may include at least one input interface and at least one output interface.

The at least one input interface may convert sensory information received from the user into an electrical signal.

The at least one input interface may include a power button, an operation button, a course selection dial (or a course selection button), and a washing/rinsing/dewatering setting button. For example, the at least one input interface may include a tact switch, a push switch, a slide switch, a toggle switch, a micro switch, a touch switch, a touch pad, a touch screen, a jog dial, and/or a microphone.

The at least one output interface may visually or audibly convey information related to an operation of the washing machine to the user.

For example, the at least one output interface may transmit information related to a washing course, a time for which the washing machine will be operated, and washing/rinsing/dewatering settings to the user. The information related to the operation of the washing machine may be output through a screen, an indicator, or a sound. For example, the at least one output interface may include a liquid crystal display (LCD) panel, a light emitting diode (LED) panel, or a speaker.

The washing machine may include a communication module for communicating with an external device in a wired and/or wireless manner.

The communication module may include at least one selected from a short-range communication module and a long-range communication module.

The communication module may transmit data to the external device (e.g., a server, a user device, and/or a home appliance) or receive data from the external device. In an embodiment, for example, the communication module may establish communication with the server and/or the user device and/or the home appliance, and transmit/receive various types of data.

In such an embodiment, the communication module may support establishing a direct communication channel (e.g., a wired communication channel) or a wireless communication channel between the external devices, and performing communication through the established communication channel. According to one or more embodiments, the communication module is a wireless communication module (e.g., a cellular communication module, a short-range wireless communication module, or a global navigation satellite system (GNSS) communication module) or a wired communication module (e.g., a local area network (LAN) communication module or a power line communication module). Among these communication modules, the corresponding communication module may communicate with the external device through a first network (e.g., a short-range communication network such as Bluetooth, wireless fidelity (WiFi) direct, or infrared data association (IrDA)) or a second network (e.g., a long-range communication network such as a legacy cellular network, a 5G network, a next-generation communication network, the Internet, or a computer network (e.g., LAN or WAN)). These various types of communication modules may be integrated into one component (e.g., a single chip) or implemented as a plurality of separate components (e.g., a plurality of chips).

The short-range wireless communication module may include a Bluetooth communication module, a Bluetooth Low Energy (BLE) communication module, a Near Field Communication module, a WLAN (Wi-Fi) communication module, a Zigbee communication module, infrared Data Association (IrDA) communication module, a Wi-Fi direct (WFD) communication module, an ultra-wideband (UWB), an Ant+ communication module, a microwave (uWave) communication module, and the like, but is not limited thereto.

The long-distance communication module may include various types of communication modules that perform long-distance communication, and may include a mobile communication unit. The mobile communicator may transmit/receive a wireless signal to/from at least one from a base station, an external terminal, and a server on a mobile communication network.

In an embodiment, the communication module may communicate with the external device such as a server, a user device, or another home appliance through a peripheral access point (AP). The access point (AP) may connect a local area network (LAN) to which the washing machine or the user device is connected to a wide area network (WAN) to which the server is connected. The washing machine or the user device may be connected to the server through the wide area network (WAN). The control unit may control various components (e.g., the driving motor and the water supply valve) of the washing machine. The control unit may control various components of the washing machine to perform at least one process including water supply, washing, rinsing, and/or dewatering according to a user input. For example, the control unit may control the driving motor to adjust a rotational speed of the drum or control the water supply valve of the water supply device to supply water to the tub.

The control unit may include hardware such as a central processing unit (CPU) or a memory and software such as a control program. For example, the control unit may include at least one memory for storing data in the form of an algorithm or a program for controlling operations of components in the washing machine, and at least one processor for performing the above-described operations using the data stored in the at least one memory. The memory and the processor may be implemented as separate chips. The processor may include one or more processor chips or may include one or more processing cores. The memory may include one or more memory chips or include one or more memory blocks. Also, the memory and the processor may be implemented as a single chip.

The disclosure provides embodiments of a washing machine in which torque used to rotate a rotating tub during a dewatering process is reduced. Hereinafter, a washing machine according to various embodiments will be described in detail with reference to accompanying drawings. In addition, like reference numerals are used for the same or similar components in the drawings, and any repetitive detailed descriptions thereof will be omitted or simplified.

FIG. 1 is a schematic block diagram of a washing machine 1 according to an embodiment of the disclosure. In the following description, terms indicating directions such as upper and lower directions, etc. are used based on a corresponding drawing for convenience. In the following description, a direction in which a rotation shaft line extends is referred to as an 'axial direction', a circumferential direction about the rotation shaft line is referred to as a 'circumferential direction', and a direction (of a diameter or radius) perpendicular to the rotation shaft line is referred to as a 'diameter direction'.

Referring to FIG. 1, for example, an embodiment of the washing machine 1 is a drum-type washing machine. The washing machine 1 may refer to a fully-automatic washing machine that may automatically perform a series of washing processes including washing, rinsing, dewatering processes, etc. The washing machine 1 may include a fixing tub (or a tub) 3, a rotating tub (or a drum) 4, a drain pump (a drain mechanism) 6, a driving unit 10, and a controller 15. The washing machine 1 may further include a case 2 and a water supply device 5.

The case 2 is a box-type container including panels, frames, etc. and forms the exterior of the washing machine 1. An inlet port 2*a* is provided in a front surface of the case 2. For example, the inlet port 2*a* may have a circular shape. The inlet port 2*a* is opened/closed by a door 2*b*. The door 2*b* may include a transparent window. A manipulation portion 2*c* having a switch, etc. for manipulation by a user may be installed above the inlet port 2*a* of the case 2.

A fixed tub 3 is installed in the case 2. The fixed tub 3 is in communication with the inlet port 2*a*. The fixed tub 3 is a cylindrical container having a bottom to be capable of storing water. An opening of the fixed tub 3 is in communication with the inlet port 2*a*. The fixed tub 3 is supported by a damper (not shown) installed in the case 2 such that a center line (axial line) thereof is upwardly inclined toward the inlet port 2*a* with respect to the horizontal direction. In other words, the fixed tub 3 is arranged so that the axial line thereof is in a direction crossing the vertical direction.

The rotating tub 4 may be a cylindrical container having a diameter slightly less than that of the fixed tub 3. The rotating tub 4 is accommodated in the fixed tub 3 to be rotatable while aligning a center line (axial line) thereof with that of the fixed tub 3. For example, the rotating tub 4 may be rotatable while the center line (axial line) thereof is upwardly inclined with respect to the horizontal direction toward the inlet port 2*a*. In other words, the rotating tub 4 is arranged in a way such that the axial line thereof is in a direction crossing the vertical direction. A circular opening 4*a* facing the inlet port 2*a* is defined or formed in the front portion of the rotating tub 4. Laundry is inserted into the rotating tub 4 through the inlet port 2*a* and the circular opening 4*a*. A plurality of dewatering holes 4*b* (only some of which are shown in FIG. 1) are defined or formed throughout the entire circumference in the side portion of the rotating tub 4. A plurality of agitating lifters 4*c* are provided on the inner circumferential surface at the side portion of the rotating tub 4. The front portion of the rotating tub 4 is rotatably supported by the inlet port 2*a*.

The water supply device 5 is installed above the fixed tub 3. The water supply device 5 may include a water supply pipe 5*a*, a water supply valve 5*b*, and a detergent inlet portion 5*c*. An upstream-side end portion of the water supply pipe 5*a* protrudes out of the washing machine 1 to be connected to a water supply source (not shown). A downstream-side end portion of the water supply pipe 5*a* is connected to a water supply port 3*a* provided in the upper portion of the fixed tub 3. The water supply valve 5*b* and the detergent inlet portion 5*c* are installed in the middle of the water supply pipe 5*a* sequentially from the upstream side. The detergent inlet portion 5*c* accommodates chemicals used in washing, such as a detergent or a fabric softener, and the chemicals are mixed with the supplied water and supplied into the fixed tub 3.

A drain port 3*b* is installed under the fixed tub 3. The drain port 3*b* is connected to the drain pump 6. The drain pump 6 discharges undesired water collected in the fixed tub 3 to the outside of the washing machine 1 through the drain pipe 6*a*. The drain pump 6 is merely an example of a drain mechanism that discharges the water collected in the fixed tub 3, and is not limited thereto.

A driving unit 10 is provided in a rear portion of the fixed tub 3. The driving unit 10 may include a unit base 20 (see FIG. 2), a shaft 30 (see FIG. 3), a motor 40 (see FIG. 2), etc. The shaft 30 passes through the rear portion of the fixed tub 3 and protrudes into the fixed tub 3. An end of the shaft 30 is fixed to a center of the rear portion of the rotating tub 4. In other words, the rear portion of the rotating tub 4 is supported by the shaft 30. The driving unit 10 directly drives the rotating tub 4 to rotate. As such, the rotating tub 4 rotates about an imaginary rotation shaft line J due to the driving of the motor 40. For example, the rotation shaft line J coincides with the center line of the fixed tub 3, the center line of the rotating tub 4, and the axial line of the shaft 30. In addition, the rotation shaft line J is arranged to extend in a direction inclined relative to the horizontal direction or in a roughly horizontal direction. In addition, the configuration of the driving unit 10 will be described in detail later.

The controller 15 controls overall operations of the washing machine 1. The controller 15 includes a processor for controlling driving operations of the washing machine, including a first process and a second process including a dewatering process. The first process may include at least one selected from a washing process, a rinsing process, and a disentangling process. The washing process, the rinsing process, and the disentangling process are performed in the stated order. In detail, the controller 15 controls the driving unit 10. For example, the controller 15 has a control circuit 16 and a drive circuit 17.

The control circuit 16 is connected to each part of the washing machine 1 to be communicable to control each part of the washing machine 1. For example, the control circuit 16 may include a processor for controlling the driving motions of the washing machine including the first process and the second process including the dewatering process, and a memory for recording programs and data for operating the processor. The drive circuit 17 receives electric power from a power source (not shown). The drive circuit 17 is electrically connected to the driving unit 10 and supplies power to the driving unit 10. As such, the driving unit 10 is driven and the rotating tub 4 is rotated. The configuration of the drive circuit 17 will be described in detail later.

Figure 2:
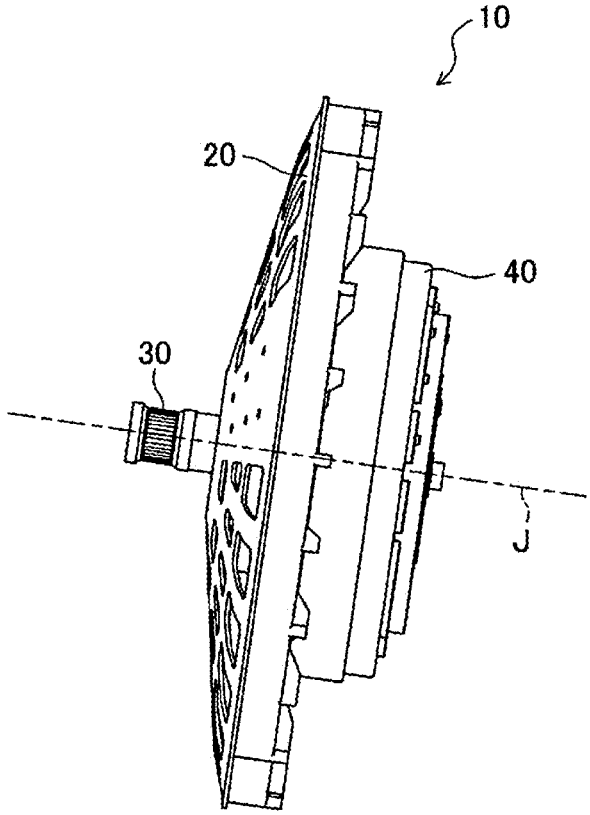
FIG. 2 is a schematic side view of a driving unit according to an embodiment of the disclosure.
Figure 3:
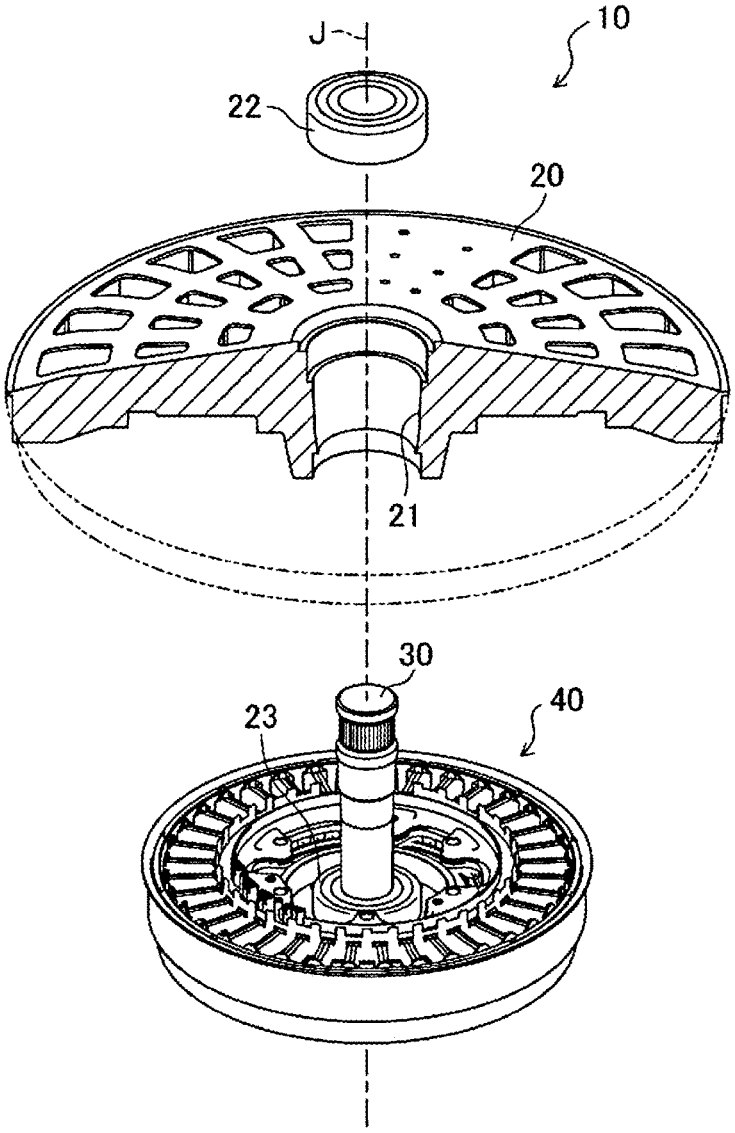
FIG. 3 is an exploded perspective view schematically showing a driving unit according to an embodiment of the disclosure.
Figure 4:
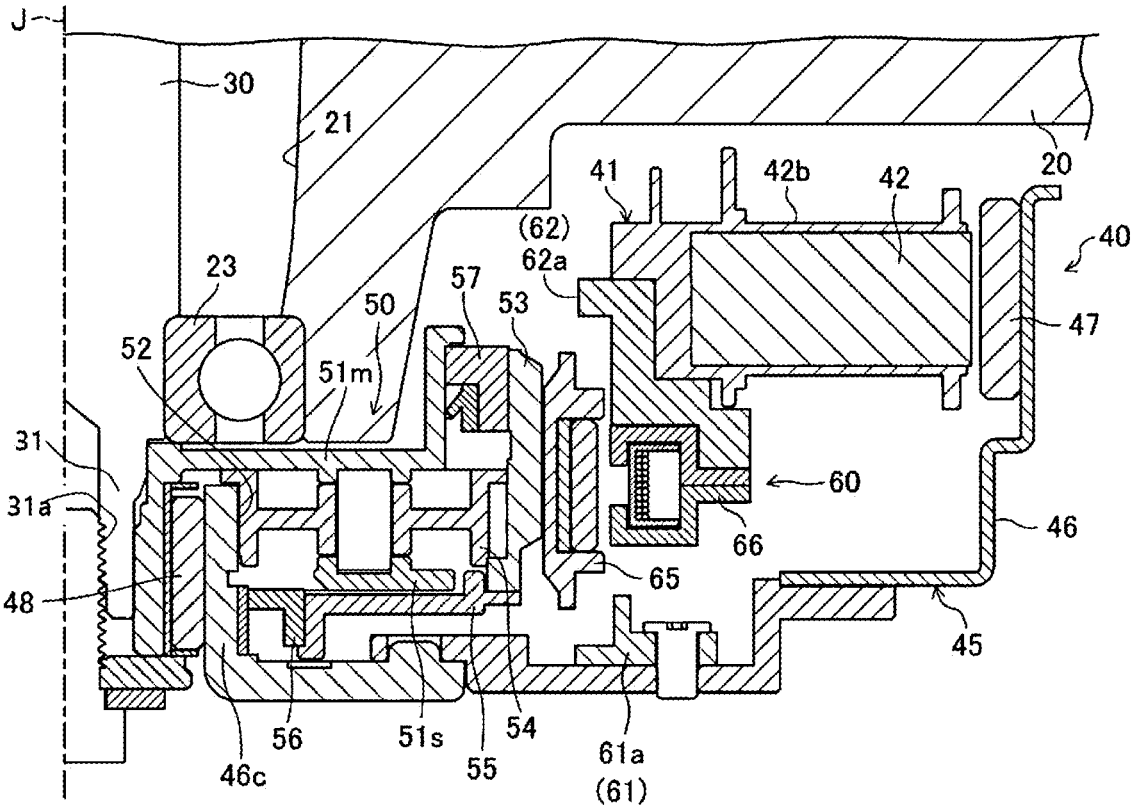
FIG. 4 is a schematic cross-sectional view of a driving unit according to an embodiment of the disclosure.

Next, the driving unit 10 according to the embodiment will be described with reference to FIGS. 2 to 11. FIG. 2 is a schematic side view of the driving unit 10 according to an embodiment of the disclosure. FIG. 3 is an exploded perspective view schematically showing the driving unit 10 according to an embodiment of the disclosure. FIG. 4 is a schematic cross-sectional view of the driving unit 10 according to an embodiment of the disclosure.

Referring to FIGS. 2 to 4, an embodiment of the driving unit 10 may include the unit base 20, the shaft 30, the motor 40, the reducer 50, and a clutch 60. For example, the motor 40, the reducer 50, and the clutch 60 may be arranged in a direction that is roughly perpendicular to the rotation shaft line J. The clutch 60 may be switched into a first mode in which the rotational force of the motor 40 is transferred to the rotating tub 4 via the reducer 50, and a second mode in which the rotational force of the motor 40 is transferred to the rotating tub 4 without being through the reducer 50 or bypassing the reducer 50.

Referring to FIG. 3, the unit base 20 is a disc-shaped member attached to the rear portion of the fixed tub 3 and may include a metal, a resin, etc. A shaft insertion hole 21 of a cylindrical shape is provided in the center of the unit base 20, and the shaft insertion hole 21 may extend along the rotation shaft line J. A pair of ball bearings (a main bearing 22 and a sub-bearing 23) are installed at opposite end portions of the shaft insertion hole 21. FIG. 3 shows the driving unit 10 in a state in which the shaft 30 and the sub-bearing 23 are assembled with the motor 40. The motor 40 is assembled to the rear side of the unit base 20.

The shaft 30 may be a cylindrical metal member having a diameter that is less than that of the shaft insertion hole 21. The shaft 30 is inserted in the shaft insertion hole 21 in a way such that the end portion thereof may protrude from the shaft insertion hole 21. The shaft 30 is supported by the unit base 20 with the pair of ball bearings 22 and 23 therebetween and may be rotatable about the rotation shaft line J.

Referring to FIG. 4, a base portion 31 of the shaft 30 protrudes from the sub-bearing 23. A main frame 51*m* of a carrier 51 of the reducer 50, which is described below, is fixed to the base portion 31 of the shaft 30. In detail, a screw hole 31*a* extending along the rotation shaft line J is formed in the base portion 31 of the shaft 30. Serrations 30*b* (see FIG. 7) extending along the rotation shaft line J are formed on an outer circumference of the base portion 31 of the shaft 30. In addition, while the base portion 31 of the shaft 30 is inserted in a shaft support 51*b* (see FIG. 7) of the main frame 51*m* that is described below, a bolt BT (see FIG. 8) is fastened with the screw hole 31*a* of the shaft 30 with a stopper STP (see FIG. 8) interposed therebetween.

Referring to FIG. 4, the motor 40 includes a stator 41 and a rotor 45. The rotor 45 faces the stator 41 with a certain gap therebetween. The rotor 45 is rotatable about the shaft 30. For example, the motor 40 is an outer rotor-type motor in which the rotor 45 is located at the outside in the radial direction of the stator 41. The motor 40 is a three-phase motor.

Figure 5:
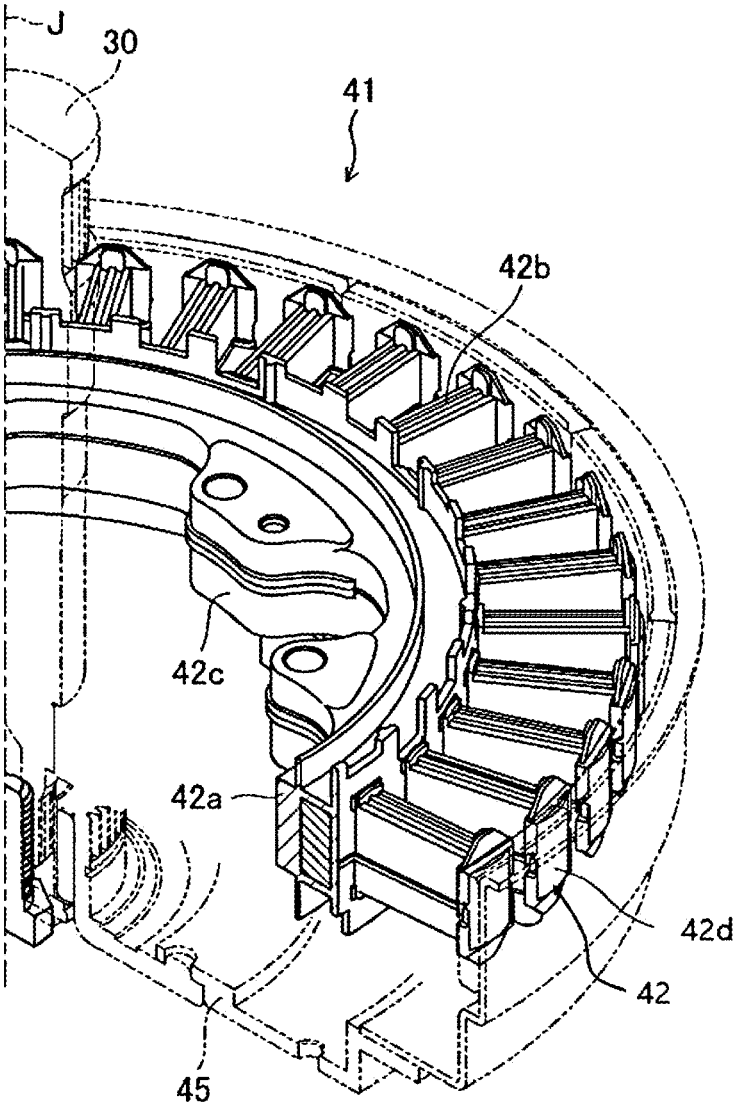
FIG. 5 is a partially-cut perspective view of a stator according to an embodiment of the disclosure.

FIG. 5 is a partially-cut perspective view of the stator 41 according to an embodiment of the disclosure. Referring to FIGS. 4 and 5, the stator 41 includes a ring-type stator core 42. The stator core 42 is coated with an insulator. The stator core 42 includes a ring-type core portion 42*a*, a plurality of teeth 42*b* radially protruding from the core portion 42*a* outwardly in the radial direction, and a fixed flange portion 42*c* installed inside the core portion 42*a*. The stator 41 is fixed to the unit base 20 with the fixed flange portion 42*c* therebetween.

A plurality of motor coils are formed by winding an electric wire on each of the plurality of teeth 42*b* in a certain order. The stator core 42 is partially exposed through protruding ends of the plurality of teeth 42*b* in the radial direction. Exposed parts 42*d* of the stator core 42 face magnets 47 of the rotor 45, which are described later, with a certain gap therebetween.

For example, the plurality of motor coils form a three-phase motor coil. In detail, as described later with reference to FIG. 12, a U-phase motor coil 43*u*, a V-phase motor coil 43*v*, and a W-phase motor coil 43*w* are configured or defined by the plurality of motor coils. Hereinafter, such motor coils will be referred to as 'motor coil 43'.

Supply of current to the motor coil 43 is controlled by the controller 15. When the current is supplied to the motor coil 43, a magnetic field for rotating the rotor 45 is generated. In detail, when an alternating current (AC) power is supplied to the motor coil 43, the magnetic field is formed between the motor coil 43 and the rotor 45. Due to the action of the magnetic field, the rotor 45 rotates about the rotation shaft line J.

Figure 6:
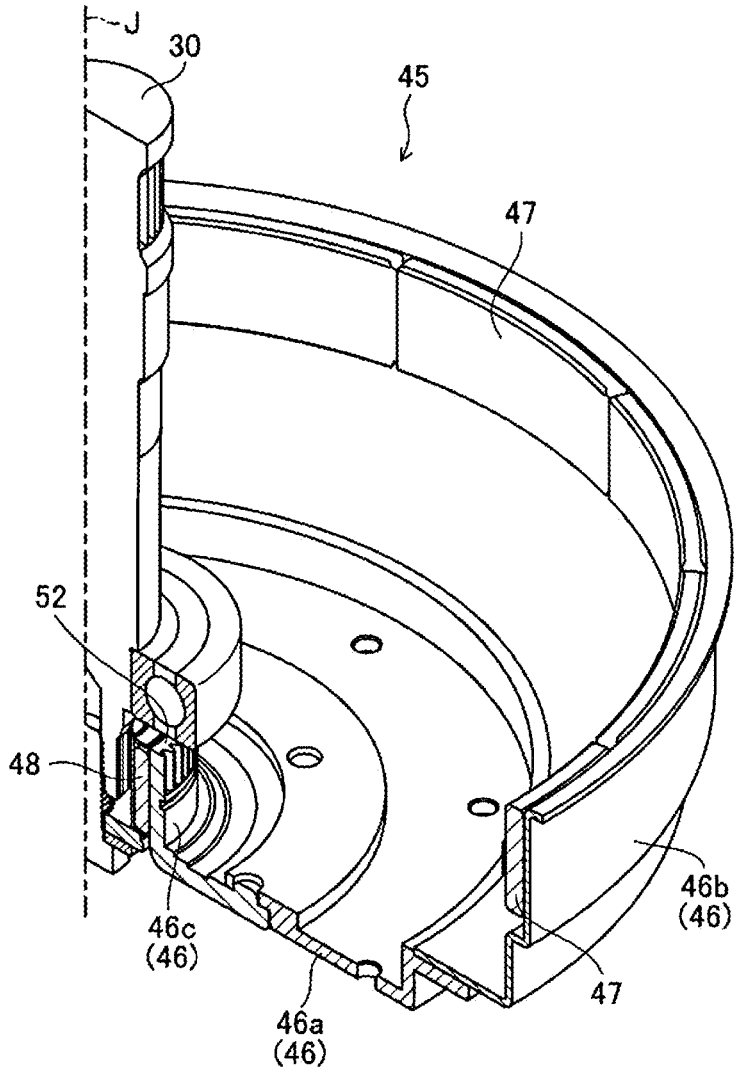
FIG. 6 is a partially-cut perspective view of a rotor according to an embodiment of the disclosure.

FIG. 6 is a partially-cut perspective view of the rotor 45 according to an embodiment of the disclosure. Referring to FIGS. 4 and 6, the rotor 45 includes a rotor case 46 and a plurality of magnets 47.

The rotor case 46 may be a cylindrical-shaped member with a bottom, of which the center aligns with the rotation shaft line J. For example, the rotor case 46 accommodates the stator 41. In detail, the rotor case 46 includes a disc-shaped bottom wall 46*a*, and a cylindrical-shaped side wall 46*b* extending from an outer edge of the bottom wall 46*a* in the rotation shaft line J direction. The bottom wall 46*a* may include a plurality of members or may include a single member. The rotor case 46 has a thin bottom (small in thickness), and has the side wall 46*b*, the height of which is less than the radius of the bottom wall 46*a*. A circular opening is formed in the center portion of the bottom wall 46*a*. The rotor case 46 includes a cylindrical shaft support 46*c* formed at the edge of the circular opening formed in the center portion of the bottom wall 46*a*. The shaft support 46*c* faces the side wall 46*b* in the diameter direction.

Each of the plurality of magnets 47 may be a rectangular permanent magnet that is curved as an arc. The plurality of magnets 47 are arranged in series in the circumferential direction and fixed to the inner surface of the side wall 46*b* of the rotor case 46. The plurality of magnets 47 form magnetic poles of the rotor 45. The plurality of magnets 47 are magnetized so that S-pole and N-pole are alternately arranged. For example, one magnet 47 may have four magnetic poles.

A cylindrical sintered oil-impregnated bearing 48 is fixed to the inside of the shaft support 46*c* in the diameter direction. The shaft support 46*c* is supported to be slidable on the shaft 30 (in particular, main frame 51*m* (see FIG. 7) fixed to the shaft 30) with the sintered oil-impregnated bearing 48 therebetween. As such, the rotor case 46 is rotatable with respect to the shaft 30.

Figure 7:
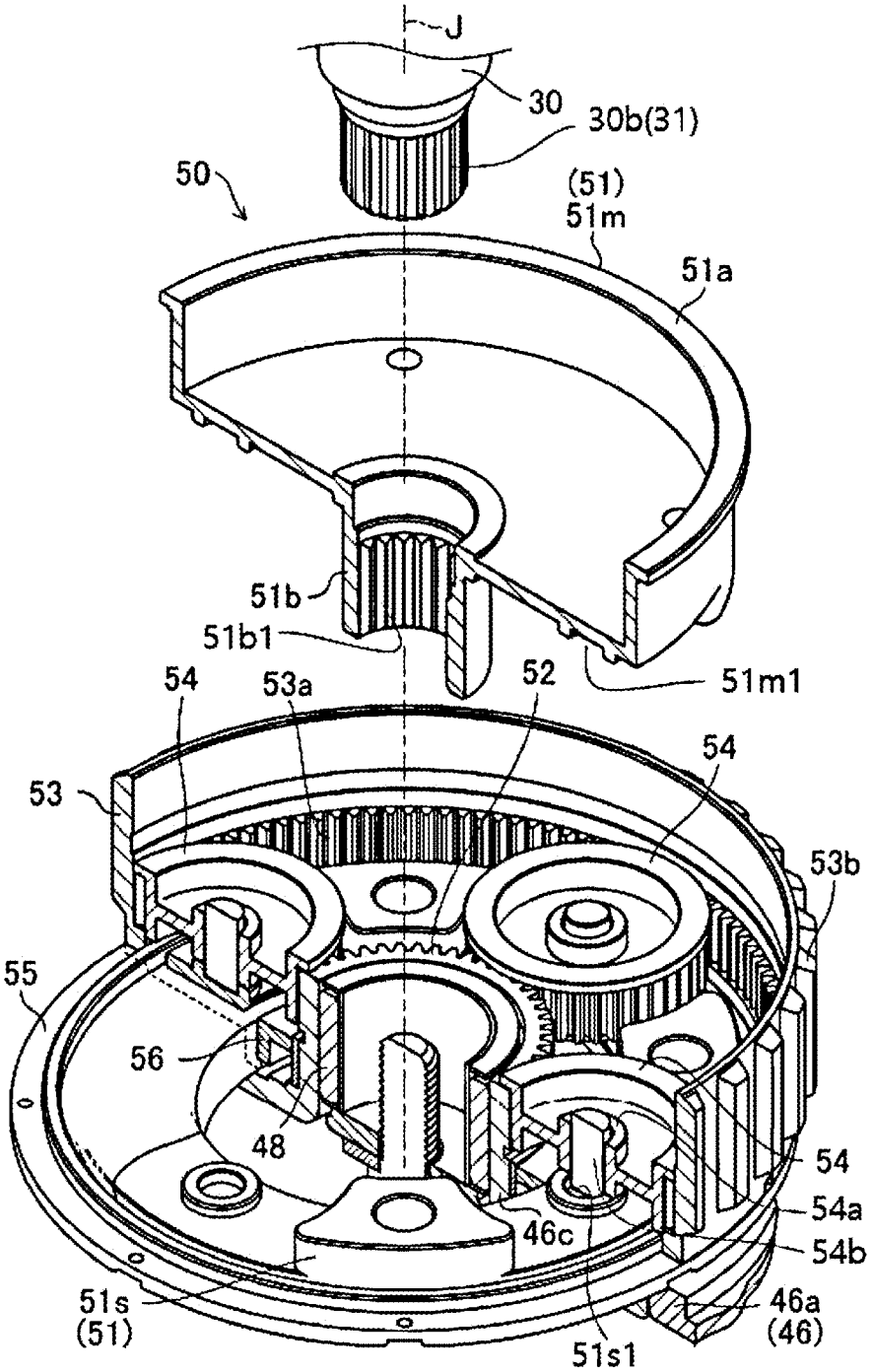
FIG. 7 is a schematic exploded perspective view of a reducer according to an embodiment of the disclosure.

FIG. 7 is a schematic exploded perspective view of the reducer 50 according to an embodiment of the disclosure. Referring to FIGS. 4 and 7, the reducer 50 is disposed between the shaft 30 and the rotor 45. The reducer 50 is arranged around the shaft support 46*c*. The reducer 50 is accommodated in the rotor case 46. The reducer 50 may be a reducer including a planetary gear. In an embodiment, for example, the reducer 50 may include a carrier 51, a sun gear 52, an internal gear 53, and a plurality of planetary gears 54 (e.g., four planetary gears in FIG. 7).

The carrier 51 is fixed to the shaft 30. For example, the carrier 51 may include the main frame 51*m* and a sub-frame 51*s*. The sub-frame 51*s* may be an annular member having a plurality of (e.g., four) lower bearing concave portions 52*s*1 respectively corresponding to the plurality of planetary gears 54. The sub-frame 51*s* is mounted onto the rotor case 46 with an annular guide plate 55 therebetween.

A ring-type first sliding member 56 is fixed to the inside of the guide plate 55 in the diameter direction. The guide plate 55 is mounted onto the bottom wall 46*a* of the rotor case 46 to be rotatable with the first sliding member 56 disposed between the guide plate 55 and the shaft support 46*c*.

The main frame 51*m* includes a cylindrical base portion 51*a* with a bottom that is shallow, and a cylindrical shaft support 51*b* protruding from the center of the base portion 51*a* to the back of the base portion 51*a*, that is, toward the sub-frame 51*s* in the axial direction. A back surface of the base portion 51*a* faces the sub-frame 51*s*. In the back surface of the base portion 51*a*, a plurality of (four in the example) upper bearing concave portions 51*m*1 are formed, and the upper bearing concave portions 51*m*1 respectively face the plurality of lower bearing concave portions 51*s*1 formed in the sub-frame 51*s* in the axial direction.

Serrations 51*b*1 engaged with the base portion 31 of the shaft 30 are formed on the inner circumference of the shaft support 51*b*. When the base portion 31 of the shaft 30 is inserted into the shaft support 51*b*, the main frame 51*m* is fixed to the shaft 30 in a non-rotatable manner with respect to the shaft 30. As described above, the shaft support 46*c* of the rotor 45 is supported around the shaft support 51*b* with the sintered oil-impregnated bearing 48 therebetween.

The sun gear 52 may be rotatable along with the rotor 45. For example, the sun gear 52 is formed on the outer circumference of the shaft support 46*c*.

The internal gear 53 surrounds the periphery of the sun gear 52. For example, the internal gear 53 may be a cylindrical member having a diameter that is greater than that of the sun gear 52. A gear portion 53*a* is provided on a lower portion of the inner circumference of the internal gear 53. The gear portion 53*a* has gear teeth formed throughout the entire circumference thereof. A plurality of internal slide guides 53*b* are formed on the outer circumference of the internal gear 53 throughout the entire circumference at constant intervals, the plurality of internal slide guides having linear protrusions extending in the axial direction.

The internal gear 53 is arranged around the sun gear 52 based on the rotation shaft line J. A lower portion of the internal gear 53 is arranged on the guide plate 55. Referring to FIG. 4, a ring-type second sliding member 57 is fixed to the inside of the upper portion of the internal gear 53. The carrier 51 (main frame 51*m*) is rotatably supported by the internal gear 53 with the second sliding member 57 therebetween.

The plurality of planetary gears 54 may be each supported by the carrier 51 to be rotatable. The plurality of planetary gears 54 are arranged between the sun gear 52 and the internal gear 53 so that each of the plurality of planetary gears 54 is engaged with the sun gear 52 and the internal gear 53.

For example, each of the plurality of planetary gears 54 may be a gear member having a small diameter. A perforated pin hole 54*a* is provided in the center of the planetary gear 54. Opposite end portions of a pin 54*b* inserted in the pin hole 54*a* are supported by the upper bearing concave portion 51*m*1 of the main frame 51*m* and the lower bearing concave portion 51*s*1 of the sub-frame 51*s*. The gear teeth are formed throughout the entire outer circumference of the planetary gears 54. The gear teeth are engaged with both the sun gear 52 and the internal gear 53.

In such an embodiment, when the sun gear 52 rotates at a certain speed while the internal gear 53 is fixed (non-rotatable state), the plurality of planetary gears 54 rotates while revolving around the sun gear 52. As such, the carrier 51 and the shaft 30 are rotated with reduced speed.

Figure 8:
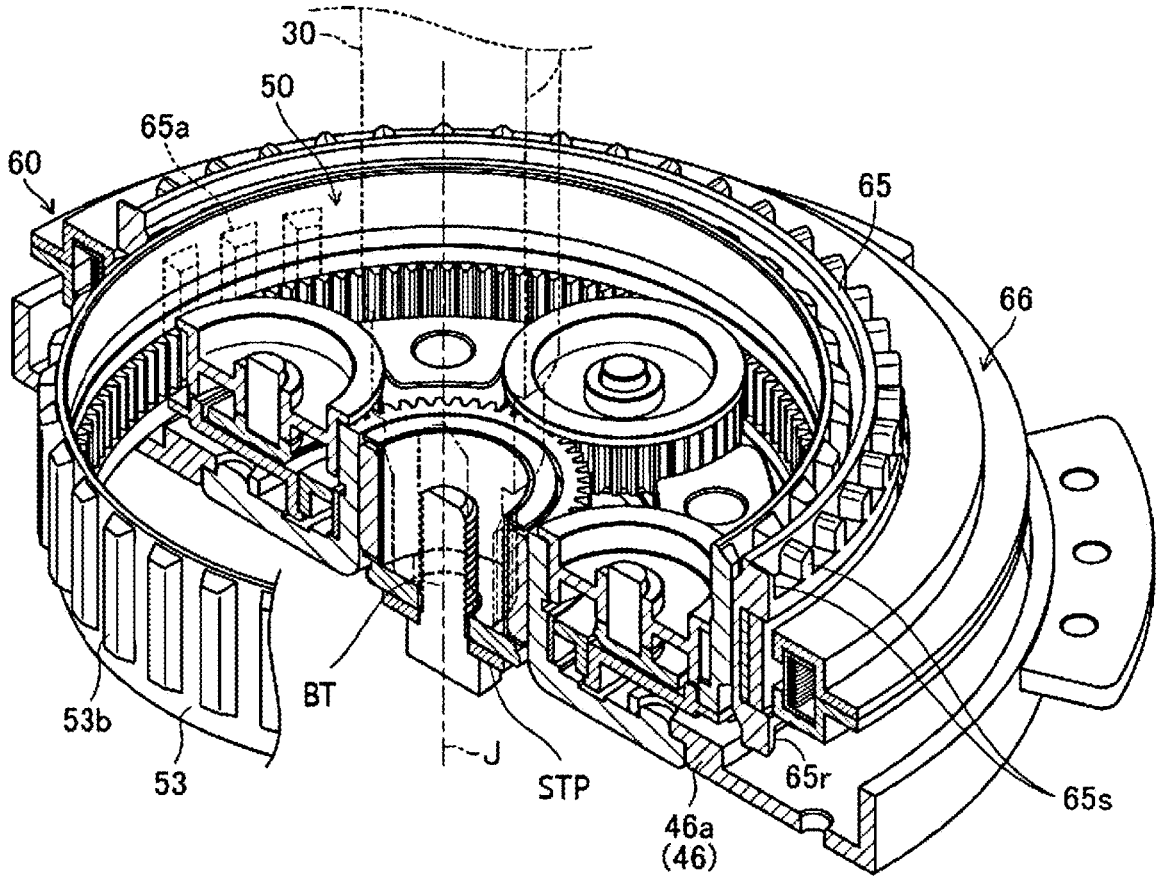
FIG. 8 is a partially-cut perspective view schematically showing the reducer and a clutch according to an embodiment of the disclosure.
Figure 9:
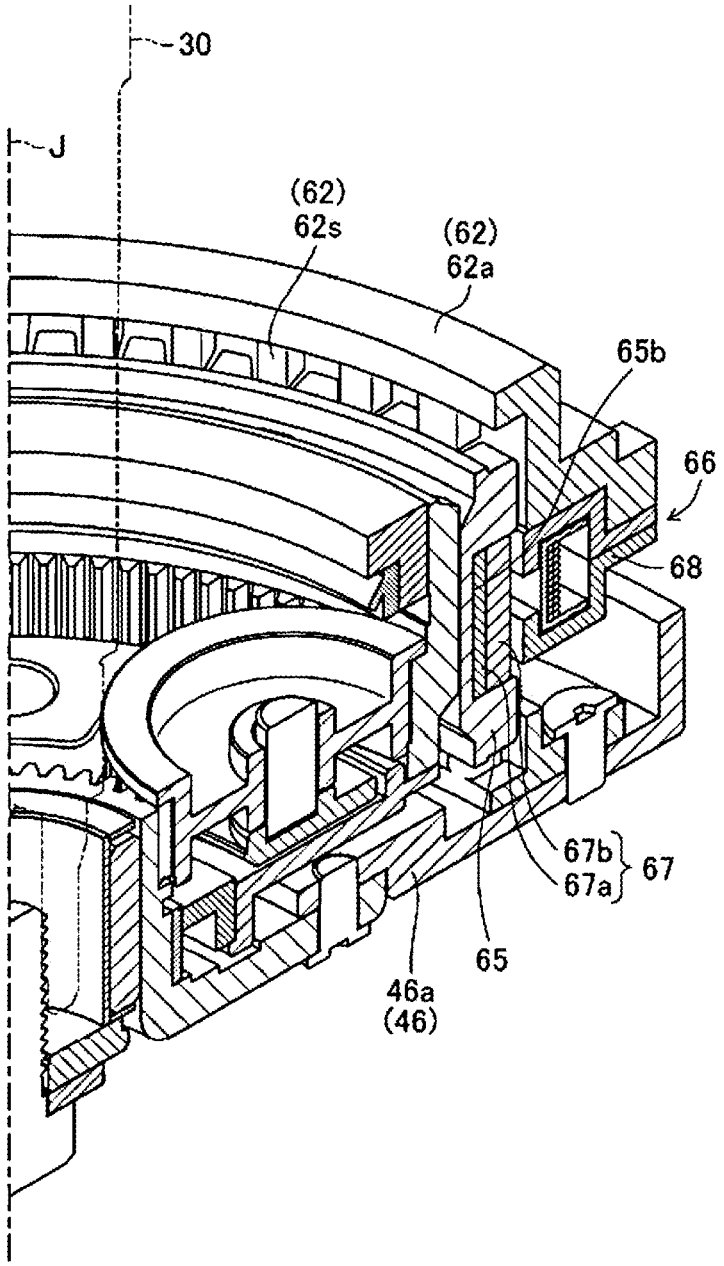
FIG. 9 is a partially-cut perspective view schematically showing the reducer and the clutch according to an embodiment of the disclosure.
Figure 10:
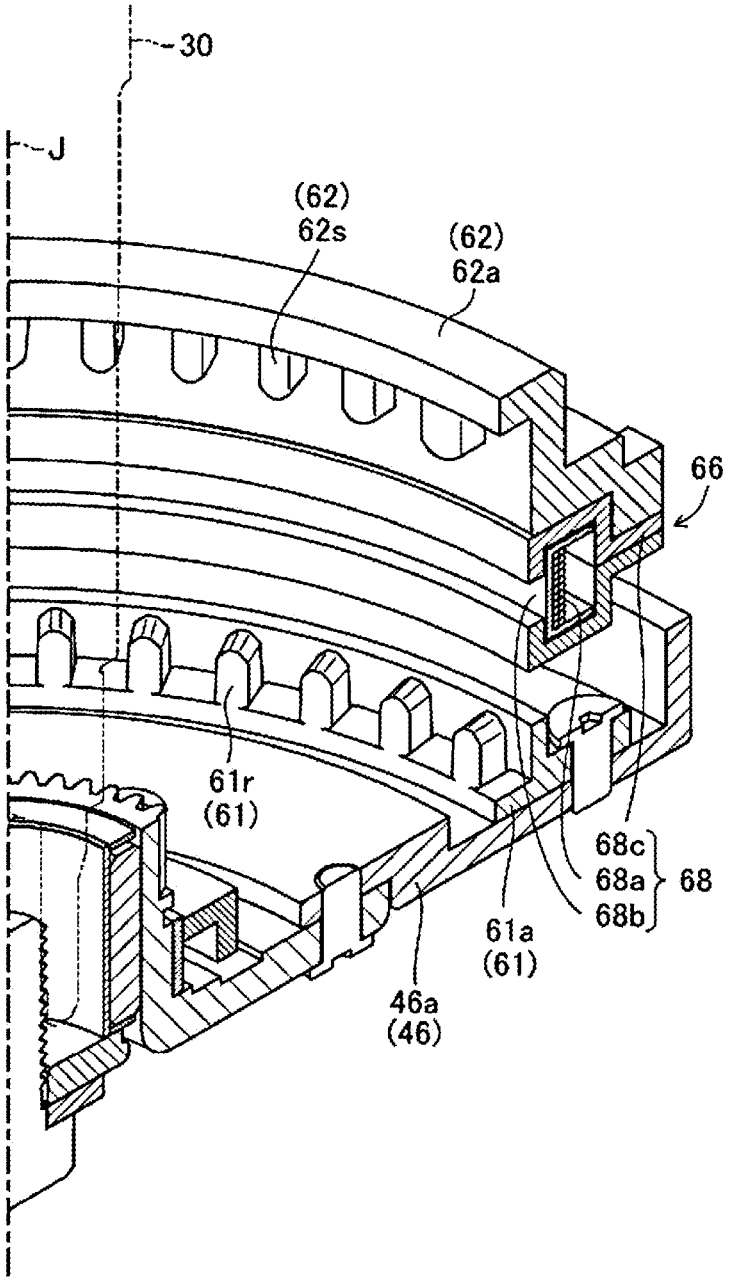
FIG. 10 is a partially-cut perspective view schematically showing the clutch according to an embodiment of the disclosure.
Figure 11:
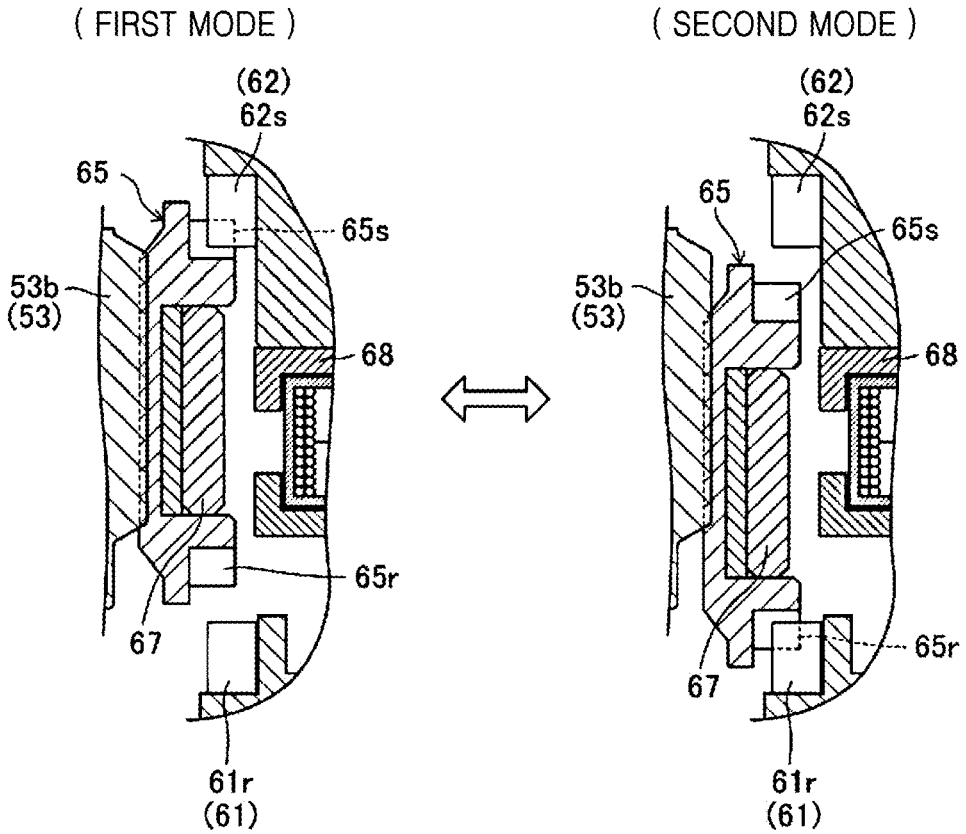
FIG. 11 is a diagram showing a first mode and a second mode of the clutch according to an embodiment of the disclosure.

FIGS. 8 and 9 are partially-cut perspective views schematically showing the reducer 50 and the clutch 60 according to an embodiment of the disclosure. FIG. 10 is a schematic partially-cut perspective view of the clutch 60 according to an embodiment of the disclosure. FIG. 11 is a diagram showing a first mode and a second mode of the clutch 60 according to an embodiment of the disclosure.

Referring to FIGS. 8 to 11, the clutch 60 is accommodated in the rotor case 46 and is arranged around the reducer 50. The clutch 60 may be switched into the first mode and the second mode. In the first mode, the rotation of the rotor 45 is transferred to the shaft 30 via the reducer 50. In the second mode, the rotation of the rotor 45 is transferred to the shaft 30 without being through the reducer 50. The clutch 60 may include a rotor-side fixing portion 61, a stator-side fixing portion 62, a movable portion 65, and a driver 66. The driver 66 may include a mover 67 and a stator 68.

The rotor-side fixing portion 61 is formed in an annular shape surrounding the periphery of the shaft 30 and may be rotatable in conjunction with the rotation of the rotor 45. For example, the rotor-side fixing portion 61 is fixed to the rotor 45. The rotor-side fixing portion 61 may be arranged at a portion rotating at an equal speed as that of the rotor 45. For example, the rotor-side fixing portion 61 may include a rotor-side base portion 61*a* and a plurality of rotor-side fixing claws 61*r*. The rotor-side base portion 61*a* is formed in an annular shape about the rotation shaft line J and mounted to the bottom wall 46*a* of the rotor case 46. The plurality of rotor-side fixing claws 61*r* are arranged in an annular shape about the rotation shaft line J and protrude from the rotor-side base portion 61*a* in the axial direction toward the movable portion 65 that is described later. In an embodiment, as shown in FIG. 10, the plurality of rotor-side fixing claws 61*r* may include a plurality of protrusions that are arranged throughout the entire circumference at constant intervals. The plurality of protrusions protrude upward.

The stator-side fixing portion 62 is formed in an annular shape surrounding the periphery of the shaft 30 and is fixed to the stator 41. The stator-side fixing portion 62 faces the rotor-side fixing portion 61 with an interval therebetween in the axial direction of the shaft 30. A distance between the rotor-side fixing portion 61 and the stator-side fixing portion 62 in the axial direction is greater than a length of the movable portion 65 in the axial direction.

For example, the stator-side fixing portion 62 is directly fixed to the stator 41. The stator-side fixing portion 62 may be indirectly fixed to the stator 41. For example, the stator-side fixing portion 62 may be arranged on a part that does not rotate, like the stator 41. In detail, the stator-side fixing portion 62 may be integrally formed with the unit base 20 or the stator core 42 as a single unitary indivisible part. That is, the state of being fixed to the stator 41 includes a state of being indirectly fixed to the stator 41, as well as a state of being directly fixed to the stator 41. Examples of the state of being indirectly fixed to the stator 41 may include a state of being arranged on a part that does not rotate (unit base 20, etc.) like the stator 41, a state of being integrally formed with the part that does not rotate like the stator 41, etc., as a single unitary indivisible part.

For example, the stator-side fixing portion 62 may include a stator-side base portion 62*a* and a plurality of stator-side fixing claws 62*s*. The stator-side base portion 62*a* is formed in an annular shape about the rotation shaft line J and is mounted onto the core portion 42*a* of the stator core 42. The plurality of stator-side fixing claws 62*s* are arranged in an annular shape based on the rotation shaft line J and protrude from the stator-side base portion 62*a* toward the movable portion 65 described later in the axial direction. In an embodiment, as shown in FIG. 10, the plurality of stator-side fixing claws 62*s* include a plurality of protrusions that are arranged at constant intervals throughout the entire circumference. The plurality of protrusions protrude downward.

The movable portion 65 is formed in an annular shape surrounding the periphery of the shaft 30. The movable portion 65 is movable in the axial direction between the rotor-side fixing portion 61 and the stator-side fixing portion 62. For example, the movable portion 65 is installed on the outer circumference of the internal gear 53. The movable portion 65 may be rotated along with the internal gear 53. The movable portion 65 is a cylindrical member having a diameter greater than that of the internal gear 53. A plurality of outer slide guides 65*a* including linear protrusions extending in the axial direction are formed on the inner circumference of the movable portion 65 throughout the entire circumference at constant intervals. The outer slide guides 65*a* are engaged with the plurality of inner slide guides 53*b* (see FIG. 11) formed on the outer circumference of the internal gear 53. The movable portion 65 is arranged on the periphery of the internal gear 53 while each of the outer slide guides 65*a* is engaged with each of the inner slide guides 53*b* of the internal gear 53. As such, the movable portion 65 is slidable in the axial direction.

The movable portion 65 includes a plurality of rotor-side movable claws 65*r* and a plurality of stator-side movable claws 65*s*. The plurality of rotor-side movable claws 65*r* are arranged in an annular shape about the rotation shaft line J and protrude toward the rotor-side fixing portion 61 in the axial direction. Referring to FIG. 11, the plurality of rotor-side movable claws 65*r* may be engaged with the plurality of rotor-side fixing claws 61*r* of the rotor-side fixing portion 61. In detail, the plurality of rotor-side movable claws 65*r* may include a plurality of protrusions that are arranged throughout the entire circumference at constant intervals. The plurality of protrusions protrude downward. The plurality of stator-side movable claws 65*s* are arranged in an annular shape about the rotation shaft line J and protrude toward the stator-side fixing portion 62 in the axial direction. Referring to FIG. 11, the plurality of stator-side movable claws 65*s* may be engaged with the plurality of stator-side fixing claws 62*s* of the stator-side fixing portion 62. In detail, the plurality of stator-side movable claws 65*s* may include a plurality of protrusions that are arranged throughout the entire circumference at constant intervals. The plurality of protrusions protrude upward.

The movable portion 65 includes a mover accommodation portion 65*b*. The mover accommodation portion 65*b* is opened outwardly in the diameter direction of the movable portion 65. The mover accommodation portion 65*b* accommodates the mover 67.

A distance between the rotor-side fixing portion 61 and the stator-side fixing portion 62 in the axial direction is greater than a length of the movable portion 65 in the axial direction. Therefore, when the rotor-side fixing portion 61 is engaged (connected) with the movable portion 65, the stator-side fixing portion 62 and the movable portion 65 are not engaged with each other, but the stator-side fixing portion 62 and the mover 67 face each other with a certain gap in the axial direction. In addition, when the stator-side fixing portion 62 and the movable portion 65 are engaged (connected) with each other, the rotor-side fixing portion 61 and the movable portion 65 are not engaged with each other, but face each other with a gap in the axial direction.

The driver 66 drives the movable portion 65. In an embodiment, as shown in FIG. 9, the mover 67 of the driver 66 has a slider core 67*a* and a clutch magnet 67*b*, and is installed on the movable portion 65. The slider core 67*a* is a cylindrical member formed of a metal material having magnetism and is installed inside the mover accommodation portion 65*b*. The clutch magnet 67*b* includes a permanent magnet. The clutch magnet 67*b* is installed throughout the entire circumference of the mover accommodation portion 65*b* while being in contact with the surface of the slider core 67*a*. For example, the clutch magnet 67*b* includes a plurality of magnetic pole members each formed in an arc shape including a thin plate of a permanent magnet. Each of the plurality of magnetic pole members includes a plurality of magnetic poles including N poles and S poles alternately arranged in the axial direction. For example, when the magnetic pole member is seen from the direction of transverse-section, the magnetic pole member has a center magnetic pole portion (e.g., S pole) and end magnetic poles (e.g., N pole) located at opposite ends in the axial direction.

In an embodiment, as shown in FIG. 10, the stator 68 of the driver 66 includes a clutch coil 68*a*, a coil holder 68*b*, and a holder support 68*c*. The coil holder 68*b* is an insulating ring-type member having an opening toward the outside in the diameter direction and has a cross-section formed in a C-shape. When the electric wire is wound on the coil holder 68*b*, the clutch coil 68*a* is formed. The holder support 68*c* includes a pair of upper and lower annular shaped members with the coil holder 68*b* inserted therebetween. The holder support 68*c* is fixed to the stator 41. As such, the clutch coil 68*a* (stator 68) faces the clutch magnet 67*b* (mover 67) with a slight gap therebetween in the diameter direction. Electrification to (or current flow in) the clutch coil 68*a* is controlled by the controller 15. When being electrified, the clutch coil 68*a* generates a magnetic field allowing the clutch magnet 67*b* to move in the axial direction. In detail, due to the electrification of the clutch coil 68*a*, the magnetic field is formed between the clutch coil 68*a* and the clutch magnet 67*b*. As such, the movable portion 65 moves in the axial direction.

In an embodiment, as shown in FIG. 11, when the movable portion 65 moves in the axial direction, the clutch 60 is switched into the first mode and the second mode. In detail, the clutch 60 is switched to the first mode when the stator-side fixing portion 62 and the movable portion 65 are engaged with each other, and the clutch 60 is switched to the second mode when the rotor-side fixing portion 61 and the movable portion 65 are engaged with each other.

In the first mode, the internal gear 53 is supported by the stator 41 via the movable portion 65. As such, the rotations of the rotor 45 and the sun gear 52 are transferred to the shaft 30 and the carrier 51 via the reducer 50. Therefore, the driving unit 10 rotates at a low speed and outputs a rotational force of a high torque.

In the second mode, the internal gear 53 is supported by the rotor 45 via the movable portion 65. As such, the rotations of the rotor 45 and the sun gear 52 are transferred to the shaft 30 and the carrier 51 without being through the reducer 50. That is, because the rotor 45, the sun gear 52, and the internal gear 53 are integrally rotated, the plurality of planetary gears 54 do not revolve. As such, the shaft 30 and the carrier 51 are also integrally rotated. Therefore, the driving unit 10 rotates at high speed and outputs a rotational force of a low torque.

Figure 12:
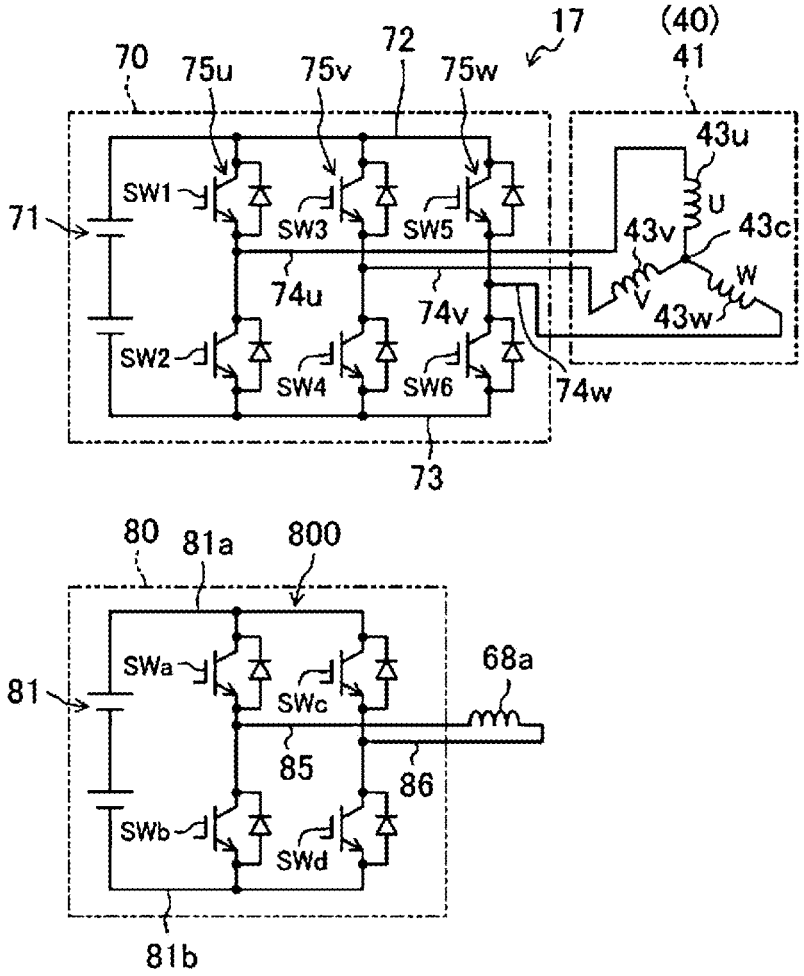
FIG. 12 is a schematic block diagram of a drive circuit according to an embodiment of the disclosure.

FIG. 12 is a schematic block diagram of the drive circuit 17 according to an embodiment of the disclosure. Referring to FIG. 12, an embodiment of the drive circuit 17 includes a motor drive circuit 70 and a clutch drive circuit 80.

In an embodiment, the motor drive circuit 70 drives the motor 40 by supplying power to the motor coil 43. The motor drive circuit 70 operates in response to the control from the control circuit 16. For example, the motor drive circuit 70 may include an inverter. In detail, the motor drive circuit 70 has a first bus 72 and a second bus 73 connected to a direct current (DC) power source 71, three output lines (a U-phase output line 74*u*, a V-phase output line 74*v*, and a W-phase output line 74*w*), and three arms (a U-phase arm 75*u*, a V-phase arm 75*v*, and a W-phase arm 75*w*). For example, the DC power source 71 may include a converter for converting an AC power supplied from a commercial use power source (not shown) to a DC power.

The U-phase motor coil 43*u*, the V-phase motor coil 43*v*, and the W-phase motor coil 43*w* are in star connection (Y connection). A connection point of the U-phase motor coil 43*u*, the V-phase motor coil 43*v*, and the W-phase motor coil 43*w* becomes a neural point 43*c*.

The U-phase output line 74*u*, the V-phase output line 74*v*, and the W-phase output line 74*w* are respectively connected to the U-phase motor coil 43*u*, the V-phase motor coil 43*v*, and the W-phase motor coil 43*w*. The U-phase arm 75*u*, the V-phase arm 75*v*, and the W-phase arm 75*w* are connected in parallel between the first bus 72 and the second bus 73. A midpoint of the U-phase arm 75*u* is connected to the U-phase output line 74*u*. A midpoint of the V-phase arm 75*v* is connected to the V-phase output line 74*v*. A midpoint of the W-phase arm 75*w* is connected to the W-phase output line 74*w*.

The U-phase arm 75*u* has a first switching element SW1 and a second switching element SW2. The first switching element SW1 and the second switching element SW2 are connected in series between the first bus 72 and the second bus 73. The first switching element SW1 is connected between the first bus 72 and the U-phase output line 74*u*. The second switching element SW2 is connected between the U-phase output line 74*u* and the second bus 73. A free wheeling diode is connected to each of the first switching element SW1 and the second switching element SW2 in a back-to-back connection (or inverse parallel connection). A connection point between the first switching element SW1 and the second switching element SW2 forms the midpoint of the U-phase arm 75*u*.

The V-phase arm 75*v* and the W-phase arm 75*w* have the same configuration as that of the U-phase arm 75*u*. The V-phase arm 75*v* has a third switching element SW3 and a fourth switching element SW4. The W-phase arm 75*w* has a fifth switching element SW5 and a sixth switching element SW6.

The motor drive circuit 70 converts the DC power supplied from a DC power source 71 into the AC power and supplies the AC power to the motor coil 43 (in the present example, the U-phase motor coil 43*u*, the V-phase motor coil 43*v*, and the W-phase motor coil 43*w*) due to switching motions for switching on/off the first to sixth switching elements SW1 to SW6. As such, the rotor 45 rotates. In addition, the switching operation of the motor drive circuit 70 is controlled by the control circuit 16. For example, the control circuit 16 controls the switching operation of the motor drive circuit 70 through a pulse width modulation (PWM) control in a way such that the rotor 45 rotates at a certain speed.

The clutch drive circuit 80 drives the clutch 60 by supplying power to the clutch coil 68*a*. The clutch drive circuit 80 operates in response to the control from the control circuit 16. For example, the clutch drive circuit 80 supplies power to the clutch coil 68*a* without using the power supplied from the motor drive circuit 70. The clutch drive circuit 80 has a first power line 81*a* and a second power line 81*b* connected to a DC power source 81, a first wiring 85, a second wiring 86, and a switching portion 800. The first wiring 85 is connected to one end of the clutch coil 68*a*. The second wiring 86 is connected to the other end of the clutch coil 68*a*. The DC power source 81 is different from the DC power source 71. For example, the DC power source 81 may include a converter converting an AC power supplied from a commercial-use power source (not shown) to a DC power.

The switching portion 800 switches connection status between the first power line 81*a* and the second power line 81*b* to the first wiring 85 and the second wiring 86. For example, the switching portion 800 includes four switching elements SWa, SWb, SWc, and SWd. The switching element SWa is connected between the first power line 81*a* and the first wiring 85, and the switching element SWb is connected between the first wiring 85 and the second power line 81*b*. The switching element SWc is connected between the first power line 81*a* and the second wiring 86, and the switching element SWd is connected between the second wiring 86 and the second power line 81*b*. By switching the connection status of the first power line 81*a* and the second power line 81*b* to the first wiring 85 and the second wiring 86, the direction of a clutch current flowing in the clutch coil 88*a* may be controlled.

For example, when an absolute value of the clutch current flowing on the clutch coil 68*a* is greater than or equal to a threshold value, the movable portion 65 is moved in the axial direction due to the magnetic field generated from the clutch coil 68*a*. Also, when the direction of the clutch current flowing in the clutch coil 68*a* changes, the moving direction (moving direction in the axial direction) of the movable portion 65 changes. In detail, when the clutch current flows from one end side to the other side of the clutch coil 68*a* (e.g., from left side to right side in FIG. 12), the movable portion 65 moves from one end side to the other side in the axial direction (e.g., from the rotor-side fixing portion 61 toward the stator-side fixing portion 62). Also, when the clutch current flows from the other end side to one end side of the clutch coil 68*a* (e.g., from right side to left side in FIG. 12), the movable portion 65 moves from the other end side to one end side in the axial direction (e.g., from the stator-side fixing portion 62 toward the rotor-side fixing portion 61).

The clutch drive circuit 80 supplies the power to the clutch coil 68*a* in a way such that the clutch current flowing on the clutch coil 68*a* becomes a target direction and an absolute value of the clutch current flowing in the clutch coil 68*a* is greater than or equal to the threshold value. The target direction is set as a direction of the clutch current when the moving direction of the movable portion 65 in the axial direction becomes the desired direction. The threshold value is set as an absolute value of the clutch current for generating a magnetic field for moving the movable portion 65. Therefore, when the direction of the clutch current is set as the target direction and the absolute value of the clutch current is set to be greater than or equal to the threshold value, the movable portion 65 may be moved to the desired direction in the axial direction.

The operation of the clutch drive circuit 80 is controlled by the control circuit 16. For example, when the movable portion 65 is to be moved from one end side to the other end side of the axial direction (e.g., from the rotor-side fixing portion 61 to the stator-side fixing portion 62), the control circuit 16 turns on the switching elements SWa and SWd and turns off the switching elements SWb and SWc in the clutch drive circuit 80. As such, the first power line 81*a* and the first wiring 85 are connected to each other, the second power line 81*b* and the second wiring 86 are connected to each other, and the clutch current flows from one end side to an opposing end side of the clutch coil 68*a* (from left side to right side in FIG. 12). As a result, the movable portion 65 moves from one end side to the opposing end side of the axial direction (e.g., from the rotor-side fixing portion 61 to the stator-side fixing portion 62).

In an embodiment, a switching process is executed by the controller 15 to allow the clutch 60 to switch to the first mode and the second mode. In the switching process, the controller 15 sets a start status in which one of the rotor-side fixing portion 61 and the stator-side fixing portion 62 and the moving portion 65 are engaged with each other, and a finishing status in which the moving portion 65 is moved in the axial direction so that the other of the rotor-side fixing portion 61 and the stator-side fixing portion 62 and the moving portion 65 are engaged with each other.

Figure 13:
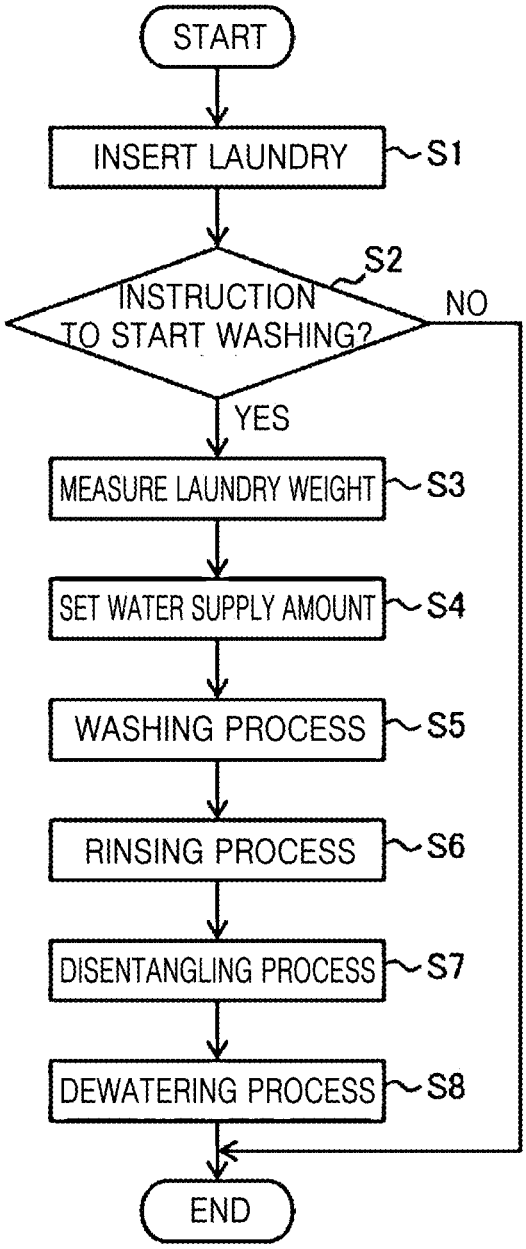
FIG. 13 is a flowchart showing a driving operation of the washing machine according to an embodiment of the disclosure.

FIG. 13 is a flowchart showing a driving operation of the washing machine 1 according to an embodiment of the disclosure. Referring to FIG. 13, a basic driving operation of the washing machine 1 is described below.

When the washing machine 1 is driven, laundry is inserted into the rotating tub 4 initially (operation S1). For example, the detergent, etc. are also inserted into the detergent inlet portion 5*c* when inserting the laundry. In addition, through the manipulation of a manipulation portion 2*c*, an instruction to start washing is input to the controller 15 (in particular, the control circuit 16) (YES to operation S2). As such, the controller 15 automatically starts a series of washing processes including washing, rinsing, dewatering, etc.

Before the washing process, the controller 15 measures the weight of the laundry to set a water supply amount (operation S3). The controller 15 sets an appropriate water supply amount based on the measured weight of the laundry (operation S4).

After finishing the setting of water supply amount, the controller 15 starts the washing process (operation S5). When the washing process starts, the controller 15 controls the water supply valve 5*b* and supplies set amount of water to the fixed tub 3. Here, the detergent accommodated in the detergent inlet portion 5*c* is inserted into the fixed tub 3 along with the supplied water.

Figure 14:
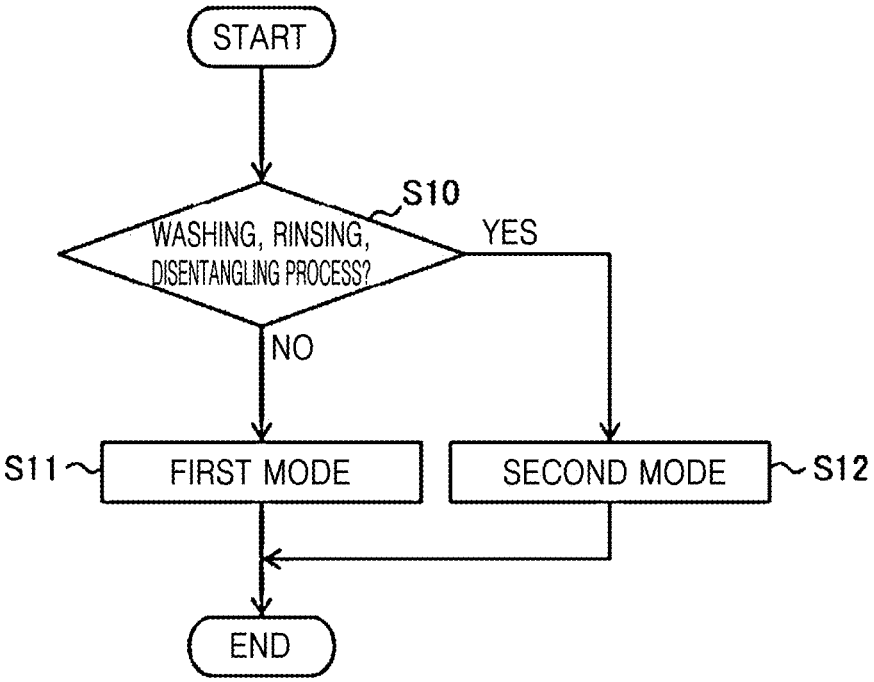
FIG. 14 is a flowchart illustrating a switching process of the clutch according to an embodiment of the disclosure.

Next, the controller 15 drives the driving unit 10 and starts the rotation of the rotating tub 4. FIG. 14 is a flowchart illustrating a switching process of the clutch 60 according to an embodiment of the disclosure. Before starting the rotation of the rotating tub 4, the controller 15 determines whether the current process is one of the washing process, the rinsing process, and a disentangling process (operation S10), as shown in FIG. 14. When the current process is one of the washing process, the rinsing process, and the disentangling process, the controller 15 sets the clutch 60 to the first mode (operation S11). In addition, when the current process is not one of the washing process, the rinsing process, and the disentangling process (e.g., when the current process is the dewatering process), the controller 15 sets the clutch 60 to the second mode (operation S12).

When the current process is the washing process (operation S5), the controller 15 sets the clutch 60 to the first mode. As such, the driving unit 10 outputs the rotational force of high torque at a low speed. Therefore, the rotating tub 4 that is relatively heavy may be rotated effectively at a low speed.

When finishing the washing process, the controller 15 starts the rinsing process (operation S6). In the rinsing process, the washing water collected in the fixed tub 3 is drained due to the driving of the drain pump 6. Next, the controller 15 executes water supply and agitating process like in the washing process. In the rinsing process, the driving unit 10 is driven while the clutch 60 is maintained in the first mode.

When finishing the rinsing process, the controller 15 executes the disentangling process (operation S7). In the disentangling process, the driving unit 10 is driven while the clutch 60 is maintained in the first mode. The disentangling process will be described in detail later.

When finishing the disentangling process, the controller 15 executes the dewatering process (operation S8). In the dewatering process, the rotating tub 4 is rotationally driven for a certain period of time at a high speed. In detail, the controller 15 switches the clutch 60 to the second mode before starting the dewatering process. When the clutch 60 is set to the second mode, the driving unit 10 outputs the rotational force of a low torque at a high speed. Therefore, the rotating tub 4 that is relatively light-weight may be rotated effectively at a high speed.

The laundry is stuck to the inner surface of the rotating tub 4 due to the centrifugal force. The water dehydrated from the laundry is drained out of the rotating tub 4. As such, the laundry is dewatered. The water collected in the fixed tub 3 due to the dewatering process is discharged due to the driving of the drain pump 6. When finishing the dewatering process, the controller 15 notifies the finishing of the washing process through ringing a certain buzzer (not shown). In addition, the driving of the washing machine 1 is finished.

Figure 15:
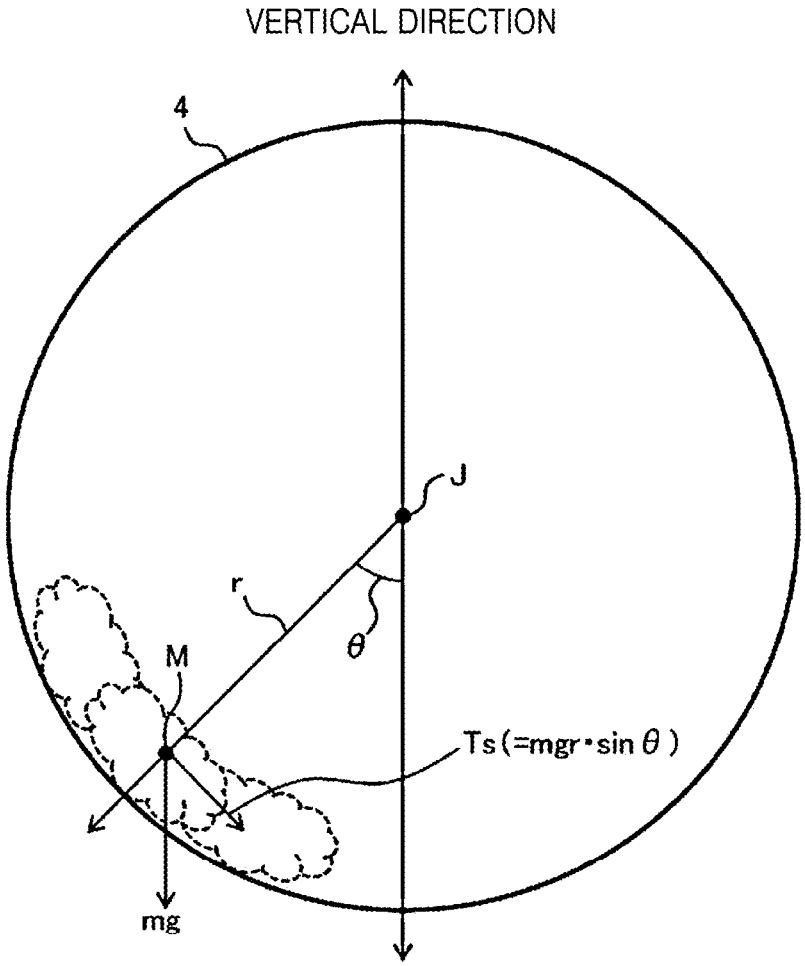
FIG. 15 is a schematic diagram for describing a load on a rotating tub.

FIG. 15 is a schematic diagram for describing a load on the rotating tub 4. Referring to FIG. 15, the load on the rotating tub 4 is described below. When a total weight of laundry including water is defined by m, the acceleration of gravity is defined by g, a center distance that is a distance between a center of the rotating tub 4 (rotation shaft line J) and a center M of the laundry in the rotating tub 4 is defined by r, and a center angle that is an angle of a straight line connecting the center of the rotating tub 4 (rotation shaft line J) to the center M with respect to a vertical direction is defined by θ, a load on the rotating tub 4, that is, load torque Ts, is mgr×sin θ.

As described above, the load torque Ts that is the load on the rotating tub 4 is changed according the total weight m of the laundry, the center distance r, and the center angle θ. As the total weight m of the laundry increases, the load torque Ts increases. As the center distance r of the laundry increases, the load torque Ts increases. As the center angle θ of the laundry is close to 90°, the load torque Ts increases.

When starting the rotation of the rotating tub 4 (initiating), the rotation speed of the rotating tub 4 is low, and thus, the centrifugal force applied to the laundry in the rotating tub 4 is small. Therefore, while the center angle θ of the laundry gradually increases, the laundry is distorted and the position of the center M of the laundry is lowered, and accordingly, the center angle θ of the laundry is reduced and the load torque Ts decreases. As the center angle θ of the laundry is reduced when the position of the center M of the laundry is lowered due to the distortion of the laundry, the increase in the load torque Ts is restrained. Even when the total weight of the laundry in the rotating tub 4 is consistent, the laundry is difficult to be distorted (difficult to be dispersed) in the case in which the laundry is entangled, and thus, the center angle θ of the laundry is easy to be increased when the position of the center M of the laundry is lowered due to the distortion of the laundry.

By disentangling the laundry in the rotating tub 4 and dispersing the laundry in the rotating tub 4, the position of the center M of the laundry may be changed in a way such that the center distance r of the laundry is reduced, and accordingly, the load on the rotating tub 4 (load torque Ts) may be reduced. Also, by dewatering the laundry in the rotating tub 4, the total weight m of the laundry may be reduced, and accordingly, the load on the rotating tub 4 (load torque Ts) may be reduced. Also, the load (load torque Ts) on the rotating tub 4 may be estimated based on the current flowing through the motor 40, the rotation speed of the rotating tub 4, vibrations of the rotating tub 4, the weight of the laundry put in the rotating tub 4, etc. For example, the controller 15 monitors the physical quantity (in particular, an output from a sensor sensing the physical quantity), and derives the load on the rotating tub 4 based on the monitoring result. The derivation of the load to the rotating tub 4 may be regularly performed.

Figure 16:
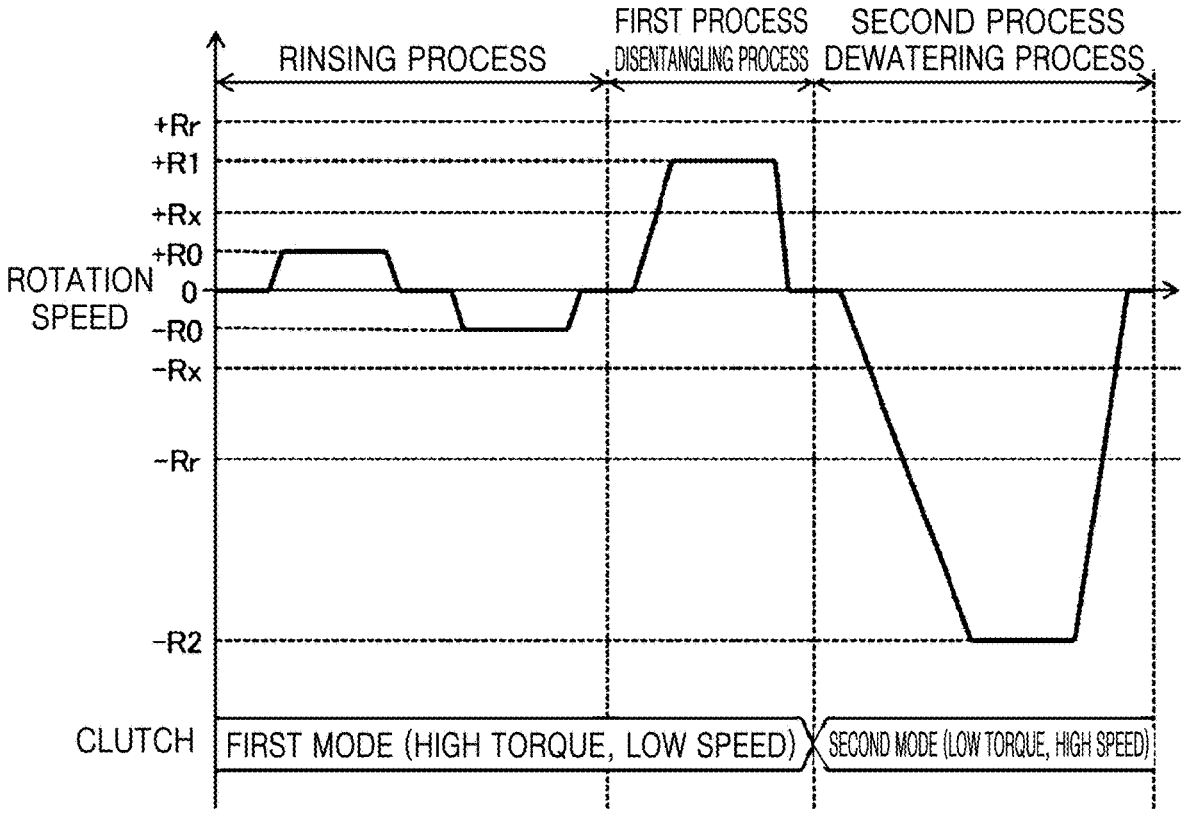
FIG. 16 is a timing chart showing principal parts during a driving operation of the washing machine according to an embodiment of the disclosure.

FIG. 16 is a timing chart showing principal parts during a driving operation of the washing machine 1 according to an embodiment of the disclosure. Referring to FIG. 16, principal parts (rinsing process, disentangling process, dewatering process) in the driving operations of the washing machine 1 are described below. In addition, the disentangling process is an example of the first process performed before the second process in which the dewatering process is performed. The dewatering process is an example of the second process.

In the rinsing process, the controller 15 may set the clutch 60 to the first mode. In addition, the controller 15 may control the motor 40 in a way such that the rotation speed of the rotating tub 4 is a predetermined rinsing rotation speed R0, that is, the controller 15 may control the motor 40 to allow the rotating tub 4 to rotate with a predetermined rinsing rotation speed R0. For example, the controller 15 controls the motor 40 in a way such that a time duration in which the rotation speed of the rotating tub 4 is maintained at the rinsing rotation speed R0 is a predetermined time duration (rinse maintaining time).

The rinsing rotation speed R0 is set to a rotation speed lower than the rotation speed that is enough or set to make the laundry stuck to the internal wall of the rotating tub 4 due to the centrifugal force (hereinafter, referred to as "certain rotation speed" Rx). That is, the centrifugal force generated in the rotating tub 4 rotating with the certain rotation speed Rx may be great enough to make the laundry stuck to the internal wall of the rotating tub 4. The rinsing rotation speed R0 is a rotation speed that is not enough to make the laundry stuck to the internal wall of the rotating tub 4 due to the centrifugal force. The certain rotation speed Rx may be determined based on experiments, simulations, etc. Also, the rinsing rotation speed R0 is different from a resonating rotation speed Rr corresponding to a resonant frequency of the washing machine 1. The resonant rotation speed is a rotation speed of the rotating tub 4 corresponding to a natural frequency of the washing machine 1, and corresponds to the rotation speed of the rotating tub 4 when the washing machine 1 is in a resonant status.

In the rinsing process, the rotation direction of the rotating tub 4 is alternately switched between a forward rotating direction set in advance and a backward rotating direction that is opposite to the forward rotating direction. In detail, the controller 15 alternately performs a forward rotation operation, in which the motor 40 is controlled in a way such that the rotating direction of the rotating tub 4 is the forward direction, and a backward rotation operation, in which the motor 40 is controlled in a way such that the rotation direction of the rotating tub 4 is the backward direction. The rotation speed of the rotating tub 4 becomes a positive rinsing rotation speed +R0 during the forward rotation operation of the rinsing process, and a negative rinsing rotation speed −R0 during the backward rotation operation of the rinsing process.

During the rinsing process, the controller 15 controls the water supply device 5 (in particular, the water supply valve 5*b*) and the drain pump 6 in a way such that the water supply to the fixed tub 3 and the drainage from the fixed tub 3 may be appropriately performed. In addition, when a rinse finishing condition that is a condition for finishing the rinsing process is satisfied, the controller 15 controls the operation of the washing machine 1 in a way such that the rinsing process is finished. When the rinsing process is finished, the controller 15 controls the operation of the washing machine 1 in a way such that the disentangling process starts. For example, the rinse finishing condition may be a condition that a preset time period (rinsing time) elapses from the start of the rinsing process.

In the disentangling process, the controller 15 sets the clutch 60 to the first mode. In addition, the controller 15 may control the motor 40 in a way such that the rotation speed of the rotating tub 4 reaches a predetermined first rotation speed R1. For example, the controller 15 controls the motor 40 in a way such that a time duration in which the rotation speed of the rotating tub 4 is maintained at the first rotation speed R1 is a predetermined time duration (first maintaining time).

The first rotation speed R1 is set as a rotation speed that is greater than or equal to the certain rotation speed Rx (the rotation speed that is enough to make the laundry stuck to the internal wall of the rotating tub 4 due to the centrifugal force). The first rotation speed R1 is a rotation speed that is enough to make the laundry stuck to the internal wall of the rotating tub 4 due to the centrifugal force. Also, the first rotation speed R1 is different from a resonating rotation speed Rr corresponding to a resonant frequency of the washing machine 1. For example, the first rotation speed R1 may be set as the maximum rotation speed of the rotating tub 4 in the first mode (a state in which the clutch is set to the first mode).

During the disentangling process, the rotating direction of the rotating tub 4 when starting the rotation is a reverse direction of the rotating direction of the rotating tub 4 when finishing the rotation in the rinsing process. In detail, the controller 15 controls the motor 40, so that the rotating direction of the rotating tub 4 when starting the rotation in the disentangling process may be the reverse direction of the rotating direction of the rotating tub 4 when finishing the rotation in the rinsing process. For example, in the timing chart of FIG. 16, the rotating direction of the rotating tub 4 when finishing the rotation in the rinsing process (during last rotation) is the backward rotation direction, and the rotating direction of the rotating tub 4 when starting the rotation of the rotating tub (during first rotation) in the disentangling process is the forward rotation direction.

For example, in the disentangling process, the controller 15 controls the water supply device 5 (in particular, the water supply valve 5*b*) in a way such that the water supply to the fixed tub 3 is stopped. In addition, when a disentangling process finishing condition that is a condition for finishing the disentangling process is satisfied, the controller 15 controls the operation of the washing machine 1 in a way such that the disentangling process may be finished. When finishing the disentangling process, the controller 15 controls the operation of the washing machine 1 in a way such that the dewatering process may start.

For example, the disentangling process finishing condition is a condition that a preset time duration (disentangling time) elapses from the start of the disentangling process, that is, the disentangling process finishing condition is satisfied at a time point after a preset time duration (disentangling time) from the start of the disentangling process. The dewatering process starts after the disentangling time elapses from the start of the disentangling process. In particular, when the elapsed time from the start of the disentangling process is measured and the elapsed time reaches the disentangling time, the controller 15 controls the operation of the washing machine 1 in a way such that the disentangling process is finished and the dewatering process starts. The disentangling time is an example of a first processing time corresponding to an elapsed time from the start of the first process to finish the first process and start the second process. For example, the disentangling time may be determined according to the load on the rotating tub 4. In particular, as the load to the rotating tub 4 increases, the disentangling time increases.

In the dewatering process, the controller 15 sets the clutch 60 to the second mode. In addition, the controller 15 may control the motor 40 in a way such that the rotation speed of the rotating tub 4 reaches a predetermined second rotation speed R2. For example, the controller 15 controls the motor 40 in a way such that a time duration in which the rotation speed of the rotating tub 4 is maintained at the second rotation speed R2 is a predetermined time duration (second maintaining time).

The second rotation speed R2 is set to be higher than the first rotation speed R1. Like the first rotation speed R1, the second rotation speed R2 is a rotation speed that is enough to make the laundry stuck to the internal wall of the rotating tub 4 due to the centrifugal force. Also, the second rotation speed R2 is different from a resonating rotation speed Rr corresponding to a resonant frequency of the washing machine 1. For example, the second rotation speed R2 is set as a maximum rotation speed of the rotating tub 4 in the second mode (a state in which the clutch is set to the second mode). As described above, the second rotation speed R2 may be set to be higher than the maximum rotation speed of the rotating tub 4 in the first mode.

During the dewatering process, the rotating direction of the rotating tub 4 when starting the rotation is a reverse direction of the rotating direction of the rotating tub 4 when finishing the rotation in the disentangling process. In detail, the controller 15 controls the motor 40 in a way such that the rotating direction of the rotating tub 4 when starting the rotation in the dewatering process may be the reverse direction of the rotating direction of the rotating tub 4 when finishing the rotation during the disentangling process. For example, in the timing chart of FIG. 16, the rotating direction of the rotating tub 4 when finishing the rotation in the disentangling process is the forward rotation direction, and the rotating direction of the rotating tub 4 when starting the rotation in the dewatering process is the backward rotation direction.

In the dewatering process, the controller 15 controls the drain pump 6 in a way such that the water collected in the fixed tub 3 may be discharged. Also, the controller 15 controls the water supply device 5 (in particular, the water supply valve 5*b*) in a way such that the water supply to the fixed tub 3 is stopped. In addition, when a dewatering finishing condition that is a condition for finishing the dewatering process is satisfied, the controller 15 controls the operation of the washing machine 1 in a way such that the dewatering process is finished. For example, the dewatering finishing condition may be a condition that a preset time duration (dewatering time) elapses from the start of the dewatering process.

The operation in the washing process may be the same as the operation in the rinsing process. In the washing process, the controller 15 may set the clutch 60 to the first mode. In addition, the controller 15 may control the motor 40 in a way such that the rotation speed of the rotating tub 4 is a predetermined washing rotation speed. For example, the controller 15 controls the motor 40 in a way such that a time duration in which the rotation speed of the rotating tub 4 is maintained at the washing rotation speed is a predetermined time duration (washing maintaining time). The washing rotation speed is set as a rotation speed that is less than the certain rotation speed Rx (the rotation speed that is enough to make the laundry stuck to the internal wall of the rotating tub 4 due to the centrifugal force). The washing rotation speed is a rotation speed that is not enough to make the laundry stuck to the internal wall of the rotating tub 4 due to the centrifugal force. Also, the washing rotation speed is different from a resonating rotation speed Rr corresponding to a resonant frequency of the washing machine 1.

In addition, when a washing finishing condition that is a condition for finishing the washing process is satisfied, the controller 15 controls the operation of the washing machine 1 in a way such that the washing process is finished. When finishing the washing process, the controller 15 controls the operation of the washing machine 1 in a way such that the rinsing process may start. For example, the washing finishing condition may be a condition that a preset time duration (washing time) elapses from the start of the washing process.

When the clutch 60 is set to the first mode, the rotation of the rotor 45 is transferred to the shaft 30 via the reducer 50. As such, the rotating tub 4 may be rotated with a higher torque than that of the case in which the clutch 60 is set to the first mode, and thus, the torque for initiating the rotation of the rotating tub 4 may be easily secured. For example, even when the load on the rotating tub 4 is large, the rotating tub 4 may be sufficiently rotated. Also, when compared with the case in which the rotation of the rotor 45 is transferred to the shaft 30 without being through the reducer 50, the motor may be driven with the revolutions having high efficiency, and thus, the motor efficiency may be improved greatly.

When the clutch 60 is set to the second mode, the rotation of the rotor 45 is transferred to the shaft 30 without being through the reducer 50. As such, the clutch 60 is set to the second mode, the rotating tub 4 and the motor 40 may be rotated at the same speed, and it is possible to drive the motor with the revolutions of high motor efficiency when the rotating tub 4 is rotated at high speed.

In an embodiment, as described above, the controller 15 sets the clutch 60 to the first mode in the disentangling process. Thus, the rotating tub 4 may be rotated with high torque in the disentangling process, and thus, the torque for initiating the rotation of the rotating tub 4 may be easily secured. For example, even when the load on the rotating tub 4 is high load (the load is high), the rotating tub 4 may be sufficiently rotated. Also, the controller 15 controls the motor 40 in a way such that the rotation speed of the rotating tub 4 is the certain rotation speed Rx (the rotation speed that is enough to make the laundry stuck to the internal wall of the rotating tub 4 due to the centrifugal force) in the disentangling process. As described above, by increasing the rotation speed of the rotating tub 4 to the certain rotation speed Rx, the tangle (lump) of the laundry in the rotating tub 4 may be released and the laundry may be dispersed in the rotating tub 4. As such, the load on the rotating tub 4 may be reduced.

The controller 15 sets the clutch 60 to the second mode in the dewatering process. As such, the rotating tub 4 may be rotated at a high speed with a low torque in the dewatering process, and thus, the motor with lower torque may be used. Because the dewatering process may start after reducing the load on the rotating tub 4 through the disentangling process, the torque to be used to rotate the rotating tub 4 in the dewatering process may be reduced.

After a preset time duration (disentangling time) elapses from the start of the disentangling process, the dewatering process starts. The disentangling time may be determined based on the load on the rotating tub 4. Due to the control as above, the disentangling process may be appropriately implemented based on the load on the rotating tub 4.

During the dewatering process, the rotating direction of the rotating tub 4 when starting the rotation is the reverse direction of the rotating direction of the rotating tub 4 when finishing the rotation in the disentangling process. Through the above control, the disentangling of the laundry in the rotating tub 4 may be accelerated, and thus, the load on the rotating tub 4 may be reduced. Likewise, during the disentangling process, the rotating direction of the rotating tub 4 when initiating the rotation is the reverse direction of the rotating direction of the rotating tub 4 when finishing the rotation in the rinsing process. Through the above control, the disentangling of the laundry in the rotating tub 4 may be accelerated, and thus, the load on the rotating tub 4 may be reduced.

The first rotation speed R1 is different from the resonant rotation speed Rr corresponding to the resonant frequency of the washing machine 1. According to the above setting, the generation of resonance of the washing machine 1 may be avoided. This may be equally applied to the second rotation speed R2, the rinsing rotation speed R0, and the washing rotation speed.

Because the load on the rotating tub 4 (load in the initiation) when starting the dewatering process may be reduced, the motor 40 may be miniaturized. As such, iron loss in the motor 40 during the dewatering process may be reduced, and high efficiency of the motor 40 may be achieved.

In embodiments described above, the disentangling time is set based on the load to the rotating tub 4 (variable value), but the disclosure is not limited thereto. In another embodiment, for example, the disentangling time may be a certain time (fixed value). In an embodiment, the dewatering time may be set based on the load to the rotating tub 4 (variable value) or may be a certain time period (fixed value).

In embodiments described above, the disentangling finishing condition is the condition that the disentangling time elapses from the start of the disentangling processes, but the disclosure is not limited to the above example. In another embodiment, for example, the disentangling finishing condition may be a condition in which the load to the rotating tub 4 is less than a predetermined threshold value. In such an embodiment, the controller 15 monitors the load to the rotating tub 4 and finishes the disentangling process when the load to the rotating tub 4 is less than the threshold value, in the disentangling process.

In an embodiment of the driving operation of the washing machine 1 as described above with reference to the flowchart shown in FIG. 13 above, the disentangling process and the dewatering process may be performed immediately after the washing process. In an embodiment, the combination of the rinsing process, the disentangling process, and the dewatering process may be performed a plurality number of times.

Figure 17:
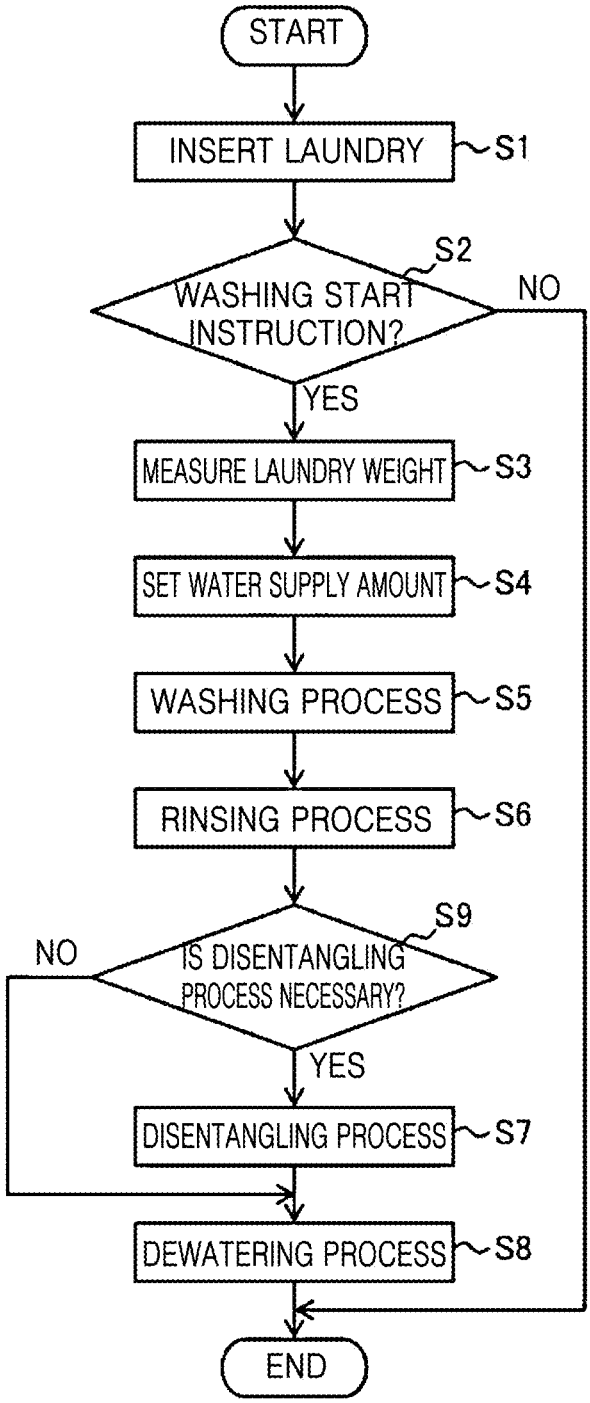
FIG. 17 is a flowchart illustrating a driving operation of the washing machine according to an embodiment of the disclosure.

In an embodiment, it is determined whether the disentangling process is to be performed, and the disentangling process may be performed according to the determination. FIG. 17 is a flowchart showing a driving operation of the washing machine 1 according to an embodiment of the disclosure. The driving operation of the washing machine 1 according to the embodiment is described below with reference to FIG. 17. The driving operation of the washing machine 1 according to the embodiment of FIG. 17 is substantially the same as the embodiment of the driving operation of the washing machine 1 described above with reference to FIGS. 13 to 16, except that a determination process (operation S9) is added between the rinsing process (operation S6) and the disentangling process (operation S7).

Therefore, different features of the driving operation are mainly described below, and any repetitive detailed description of the same or like processes of the driving operation as those described above will be omitted.

In the determination process, the controller 15 determines whether the disentangling process (operation S7) is to be performed or not. For example, when the measured load value of the rotating tub 4 exceeds the preset threshold value, the controller 15 determines that the disentangling process is to be performed, and when the measured load value of the rotating tub 4 does not exceed the threshold value, the controller 15 may determine that the disentangling process is not to be performed.

When it is determined that the disentangling process is to be performed (YES to operation S7), the controller 15 controls the operation of the washing machine 1 in a way such that the disentangling process (operation S7) may be performed. In addition, when it is determined that the disentangling process is not to be performed (NO to operation S7), the controller 15 controls the operation of the washing machine 1 in a way such that the dewatering process (S8) is performed without performing the disentangling process. The controller 15 controls the drain pump 6 (drain mechanism) in a way such that the water collected in the fixed tub 3 is drained, in the final stage of the washing or rinsing process (in the example, rinsing process). In addition, the controller 15 determines whether the disentangling process is to be performed by measuring the load to the rotating tub 4 after draining the fixed tub 3, and determines the disentangling time.

According to the embodiment of the driving operation of the washing machine 1 shown in FIG. 17, the same effects as those of the driving operation of the washing machine 1 according to the embodiment described above with reference to FIGS. 13 to 16 may be obtained. Moreover, according to the embodiment, the disentangling process may be selectively performed (e.g., based on the load on the rotating tub 4). Also, the controller 15 controls the drain pump 6 (drain mechanism) so that the water collected in the fixed tub 3 is drained, in the final stage of the washing or rinsing process (e.g., rinsing process), and measures the load to the rotating tub 4. Due to the above configuration, when measuring the load to the rotating tub 4, the rotating tub 4 may not thrust the water collected in the fixed tub 3. As such, the load on the rotating tub 4 may be measured while the torque for the rotating tub 4 to thrust the water is excluded, the determination on whether the disentangling process is to be performed and the determination on the disentangling time may be accurately implemented.

Figure 18:
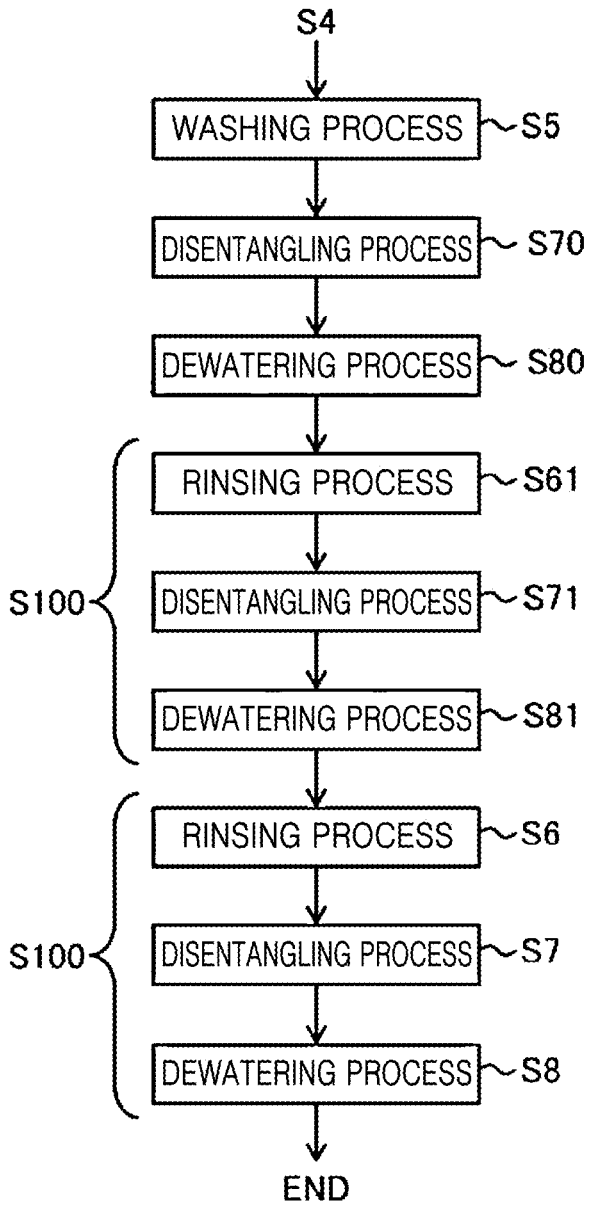
FIG. 18 is a flowchart illustrating a driving operation of the washing machine according to an embodiment of the disclosure.

FIG. 18 is a flowchart showing a driving motion of the washing machine 1 according to an embodiment of the disclosure. The driving operation of the washing machine 1 according to the embodiment is described below with reference to FIG. 18. The driving operation of the washing machine 1 according to the embodiment of FIG. 18 is substantially the same as the embodiments of the driving operation of the washing machine 1 described above, except that the disentangling process (operation S70), the dewatering process (operation S80), the rinsing process (operation S61), the disentangling process (operation S71), and the dewatering process (operation S81) are performed between the washing process (operation S5) and the rinsing process (operation S6). Hereinafter, different features of the driving operation are mainly described below, and any repetitive detailed description of the same or like processes of the driving operation as those described above will be omitted.

According to an embodiment, immediately after the washing process (operation S5), the disentangling process (operation S70) and the dewatering process (operation S80) are performed. Also, after the dewatering process (operation S80), a combination of the rinsing process, the disentangling process, and the dewatering process (operation S100) is performed twice.

In such an embodiment, the first rinsing process (operation S61) is the same as the rinsing process (operation S6) described above with reference to FIGS. 13 to 16. In addition, the rotating direction of the rotating tub 4 when starting the rotation in the first rinsing process (operation S61) is the reverse direction of the rotating direction of the rotating tub 4 when finishing the rotation during the first dewatering process (operation S80).

In such an embodiment, the first disentangling process (operation S70) and the second disentangling process (operation S71) are the same as the disentangling process (operation S7) described above with reference to FIGS. 13 to 16. In the first disentangling process (operation S70) performed after the washing process (operation S5), the rotating direction of the rotating tub 4 when starting the rotation is the reverse direction of the rotating direction of the rotating tub 4 when finishing the rotation in the washing process (operation S5). In the second disentangling process (operation S71) performed after the first rinsing process (operation S61), the rotating direction of the rotating tub 4 when initiating the rotation is the reverse direction of the rotating direction of the rotating tub 4 when finishing the rotation in the rinsing process (operation S61).

In such an embodiment, the first dewatering process (operation S80) and the second dewatering process (operation S81) are the same as the dewatering process (operation S8) described above with reference to FIGS. 13 to 16. In the first dewatering process (operation S80), the rotating direction of the rotating tub 4 when initiating the rotation is the reverse direction of the rotating direction of the rotating tub 4 when finishing the rotation in the first disentangling process (operation S70). In the second dewatering process (operation S81), the rotating direction of the rotating tub 4 when initiating the rotation is the reverse direction of the rotating direction of the rotating tub 4 when finishing the rotation in the second disentangling process (operation S71).

According to an embodiment of the driving operation of the washing machine 1 of FIG. 18, the same effects as those of the driving operation of the washing machine 1 according to the embodiments described above may be obtained.

Figure 19:
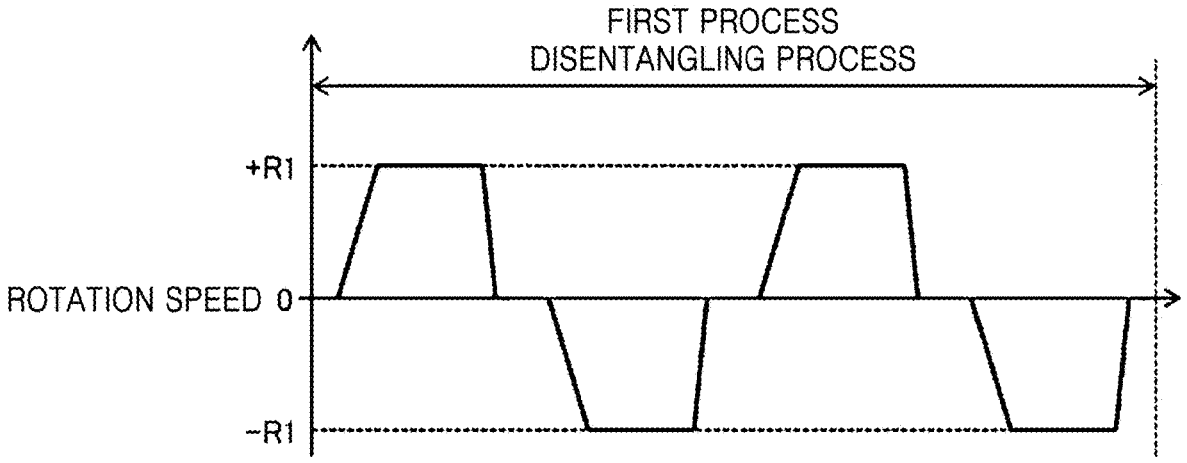
FIG. 19 is a timing chart showing an example of a rotation speed of the rotating tub in a disentangling process.

FIG. 19 is a timing chart showing an example of a rotation speed of the rotating tub 4 in the disentangling process. In the driving operation of the washing machine 1 according to the embodiments described above, the rotating direction of the rotating tub 4 in the disentangling process may be alternately switched to the forward rotation direction set in advance and the backward rotation direction that is opposite to the forward rotation direction, as shown in FIG. 19.

The controller 15 alternately performs a forward rotation operation, in which the motor 40 is controlled in a way that the rotating direction of the rotating tub 4 is the forward direction, and a backward rotation operation, in which the motor 40 is controlled in a way that the rotation direction of the rotating tub 4 is the backward direction. The rotation speed of the rotating tub 4 is the positive first rotation speed +R1 in the forward rotation operation in the disentangling process and the negative first rotation speed −R1 in the backward rotation operation of the disentangling process.

According to the embodiment of FIG. 19, the same effects as those of the driving operation of the washing machine 1 according to the embodiments described above may be obtained. Also, according to the embodiment of FIG. 19, the rotating direction of the rotating tub 4 in the disentangling process is alternately switched to the forward rotation direction and the backward rotation direction, and thus, the disentangling of the laundry in the rotating tub 4 may be assisted. As such, the load on the rotating tub 4 may be reduced.

The operation of the controller 15 in the dewatering process is not limited to those of the above embodiments. According to an embodiment, the controller 15 executes a preliminary dewatering operation and then executes a main dewatering operation, in the dewatering process of the washing machine 1. In other words, the dewatering process according to the embodiment includes a preliminary dewatering process and a main dewatering process after the preliminary dewatering process. The controller 15 executes the preliminary dewatering operation in the preliminary dewatering process and executes the main dewatering operation in the main dewatering process. In the driving operation of the washing machine 1 according to an embodiment, the disentangling process (operation S7) in the above embodiments of the driving operation of the washing machine 1 may be omitted. Other processes of the driving operation of the washing machine 1 according to the embodiment of FIG. 19 are the same as those of the driving operation of the washing machine 1 according to the embodiments described above.

In the preliminary dewatering operation, the controller 15 rotates the rotating tub 4 by controlling the motor 40 while the clutch 60 is set to the first mode. The first mode is a mode in which the rotation of the rotor 45 is transferred to the shaft 30 via the reducer 50. In the preliminary dewatering operation, the controller 15 controls the drain pump 6 so that the water collected in the fixed tub 3 may be discharged. In the main dewatering operation, the controller 15 rotates the rotating tub 4 by controlling the motor 40 while the clutch 60 is set to the second mode. The second mode is a mode in which the rotation of the rotor 45 is transferred to the shaft 30 without being through the reducer 50. In the main dewatering operation, the controller 15 controls the drain pump 6 so that the water collected in the fixed tub 3 may be discharged. The rotation speed (first rotation speed and second rotation speed) of the rotating tub 4 in the dewatering process may be set as the rotation speed that is high enough to make the laundry in the rotating tub 4 stuck to the internal wall of the rotating tub 4 due to the centrifugal force.

Figure 20:
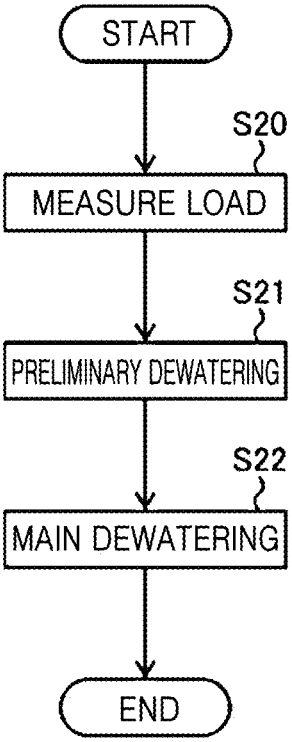
FIG. 20 is a flowchart showing operations of a controller in a dewatering process according to an embodiment of the disclosure.

FIG. 20 is a flowchart showing operations of the controller 15 in a dewatering process according to an embodiment of the disclosure. The operation of the controller 15 in the dewatering process will hereinafter be described with reference to FIG. 20.

In the dewatering process, the controller 15 (e.g., the control circuit 16) drives the drain pump 6. As such, the water collected in the fixed tub 3 through the dewatering process is discharged. Also, in the dewatering process, the controller 15 performs the following processes. The preliminary dewatering process is an example of the first process performed before the second process in which the dewatering is performed. The main dewatering process is an example of the second process.

First, the controller 15 measures the load to the rotating tub 4 (operation S20). For example, the controller 15 measures the load to the rotating tub 4 based on an output from a current sensor (not shown) that senses the current flowing on the motor 40 (in particular, the motor coil 43). For example, as the weight of the laundry including moisture in the rotating tub 4 increases, the load on the rotating tub 4 increases, and the current flowing on the motor 40 also increases.

Next, the preliminary dewatering process starts. In the preliminary dewatering process, the controller 15 performs the preliminary dewatering process (operation S21). In the preliminary dewatering process, the controller 15 sets the clutch 60 to the first mode. When the clutch 60 is already in the first mode, the controller 15 maintains the clutch 60 in the first mode. In addition, the controller 15 controls the motor 40 so that the rotation speed of the rotating tub 4 may be the first rotation speed. The first rotation speed is equal to the first rotation speed R1 in the previous embodiments. For example, the first rotation speed is set to be the maximum rotation speed of the rotating tub 4 in the first mode.

In addition, when a preliminary dewatering process finishing condition that is a condition for finishing the preliminary dewatering operation (preliminary dewatering process) is satisfied, the controller 15 finishes the preliminary dewatering operation. For example, the preliminary dewatering process finishing condition is a condition in which a preset time duration (preliminary dewatering time) elapses from the start of the preliminary dewatering operation (preliminary dewatering process). For example, the controller 15 sets the preliminary dewatering time based on the load measured in operation S20. As the load on the rotating tub 4 increases, the preliminary dewatering time increases.

Next, when the preliminary dewatering process is finished and the preliminary dewatering operation is finished, the main dewatering process starts. In the main dewatering process, the controller 15 executes the main dewatering operation (operation S22). In the main dewatering process, the controller 15 sets the clutch 60 to the second mode. In addition, the controller 15 controls the motor 40 in a way such that the rotation speed of the rotating tub 4 may be the second rotation speed. The second rotation speed is equal to the second rotation speed R2 in the embodiments described above. For example, the second rotation speed is set as the maximum rotation speed of the rotating tub 4 in the second mode.

In addition, when a main dewatering process finishing condition that is a condition for finishing the main dewatering operation (main dewatering process) is satisfied, the controller 15 finishes the main dewatering operation. For example, the main dewatering process finishing condition is a condition in which a preset time duration (main dewatering time) elapses from the start of the main dewatering operation (main dewatering process).

When the clutch 60 is set to the first mode, the rotation of the rotor 45 is transferred to the shaft 30 via the reducer 50. As such, the rotating tub 4 may be rotated with a higher torque than that of the case in which the clutch 60 is set to the second mode, and thus, the torque for initiating the rotation of the rotating tub 4 may be easily secured. For example, even when the load on the rotating tub 4 (in particular, weight of laundry including moisture) is large, the torque to start the rotation of the rotating tub 4 may be easily secured. Therefore, for example, even when the load on the rotating tub 4 is large, the rotating tub 4 may be sufficiently rotated. Also, when compared with the case in which the rotation of the rotor 45 is transferred to the shaft 30 without being through the reducer 50, the motor may be driven with the revolutions having high efficiency, and thus, the motor efficiency may be improved greatly.

In addition, when the clutch 60 is set to the second mode, the rotation of the rotor 45 is transferred to the shaft 30 without being through the reducer 50. As such, the clutch 60 is set to the second mode, the rotating tub 4 and the motor 40 may be rotated at the same speed, and it is possible to drive the motor with the revolutions of high motor efficiency when the rotating tub 4 is rotated at high speed.

According to the embodiment of the driving operation of the washing machine 1 shown in FIG. 20, the same effects as those of the previous embodiments may be obtained. Also, according to the embodiment of FIG. 20, in the dewatering process of the washing machine 1, the controller 15 executes the preliminary dewatering process, in which the rotating tub 4 is rotated by controlling the motor 40 while the clutch 60 is set to the first mode, and after that, executes the main dewatering process in which the rotating tub 4 is rotated by controlling the motor 40 while the clutch 60 is set to the second mode. In such an embodiment, the load on the rotating tub 4 (e.g., the weight of the laundry including moisture) in the preliminary dewatering process is reduced, and then, the main dewatering operation may be performed. That is, in the dewatering process, the rotating tub 4 may be rotated while the clutch 60 is set to the first mode in the section in which the load on the rotating tub 4 is relatively large, and the rotating tub 4 may be rotated while the clutch 60 is set to the second mode in the section in which the load on the rotating tub 4 is relatively small. As such, the motor 40 may be effectively driven in the dewatering process.

Also, according to the embodiment of FIG. 20, the controller 15, in the preliminary dewatering process, sets the clutch 60 to the second mode and controls the motor 40 so that the revolutions of the rotating tub 4 becomes the certain rotation speed Rx (rotation speed that is enough to make the laundry in the rotating tub 4 stuck to the internal wall of the rotating tub 4 due to the centrifugal force). Also, in the preliminary dewatering process, the controller 15 controls the drain pump 6 so that the water collected in the fixed tub 3 is discharged. Through the above configuration, the drainage from the fixed tub 3 may be carried out while rotating the rotating tub 4 at the certain rotation speed Rx, and thus, the weight of the laundry (weight of the laundry including moisture) may be reduced by extracting moisture from the laundry in the rotating tub 4. As such, the load on the rotating tub 4 may be reduced.

In an embodiment, as described above, the preliminary dewatering time is set based on the load to the rotating tub 4 (variable value), but the disclosure is not limited thereto. In another embodiment, for example, the preliminary dewatering time may be a certain time (fixed value). In such an embodiment, operation S20 may be omitted. In an embodiment, the main dewatering time may be set based on the load to the rotating tub 4 (variable value) or may be a certain time period (fixed value).

Also, an embodiment, the preliminary dewatering process finishing condition is a condition that the preset time duration (preliminary dewatering time) elapses from the start of the preliminary dewatering operation (preliminary dewatering process), but the disclosure is not limited thereto. In another embodiment, for example, the preliminary dewatering process finishing condition may be a condition in which the load to the rotating tub 4 is less than a predetermined threshold value. In such an embodiment, the controller 15 monitors the load to the rotating tub 4 and terminates the preliminary dewatering process when the load to the rotating tub 4 is less than the threshold value, in the preliminary dewatering process.

Figure 21:
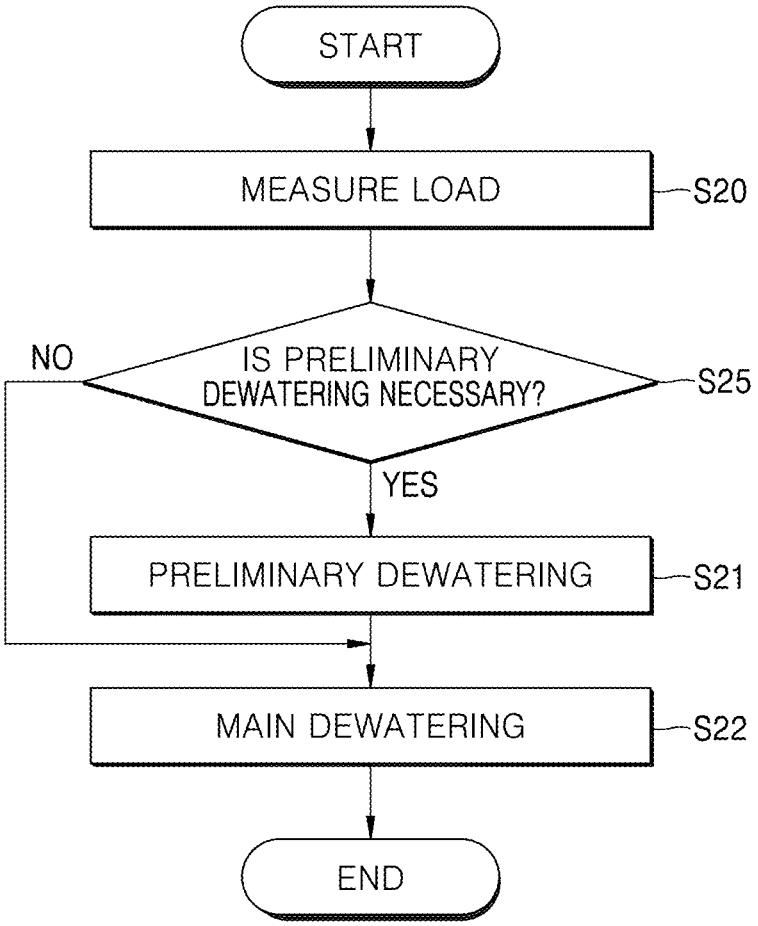
FIG. 21 is a flowchart showing operations of the controller in the dewatering process according to an embodiment of the disclosure.

The controller 15 determines whether the preliminary dewatering operation is to be performed, and the controller 15 may perform the preliminary dewatering operation (preliminary dewatering process) based on the determination. FIG. 21 is a flowchart showing operations of the controller 15 in a dewatering process according to an embodiment of the disclosure. Referring to FIG. 21, the operation of the controller 15 (operation of the controller 15 in the dewatering process) is described below.

First, as described above, the controller 15 measures the load on the rotating tub 4 (operation S20). Next, the controller 15 determines whether the preliminary dewatering operation is necessary, that is, whether the preliminary dewatering operation is to be performed (operation S25). For example, when the load value measured in operation S20 exceeds the threshold value, the controller 15 determines that the preliminary dewatering operation is to be performed, and when the load value measured in operation S20 does not exceed the threshold value, the controller 15 determines that the preliminary dewatering operation is not to be performed.

When it is determined that the preliminary dewatering operation is to be performed (YES to operation S25), the controller 15 executes the preliminary dewatering operation (operation S21). In addition, when the preliminary dewatering operation is finished, the controller 15 executes the main dewatering operation (operation S22). In addition, when it is determined that the preliminary dewatering operation is not to be performed (NO to operation S25), the controller 15 executes the main dewatering operation without performing the preliminary dewatering operation (operation S22).

According to the embodiment of FIG. 21, the same effects as those of the embodiment described with reference to FIG. 20 may be obtained. Also, according to the embodiment of FIG. 21, the preliminary dewatering operation may be appropriately executed according to the determination (e.g., based on the load on the rotating tub 4).

The dewatering process including the preliminary dewatering process and the main dewatering process may be performed immediately after the washing process. Also, the combination of the rinsing process and the dewatering process (preliminary dewatering process and the main dewatering process) may be performed a plurality number of times.

In the preliminary dewatering process, as shown in FIG. 19, the rotating direction of the rotating tub 4 may be alternately switched to the forward rotation direction set in advance and the backward rotation direction that is the opposite direction to the forward rotation direction.

In the above description, an embodiment in which the movable portion 65 is moved in the axial direction by the magnetic field generated from the clutch coil 68*a* is described, but the disclosure is not limited thereto. For example, the driving mechanism (driver 66) for moving the movable portion 65 in the axial direction may include an electronic driving mechanism using a solenoid coil, a radial coil, etc., or a mechanical driving mechanism using a spring, a motor, etc. Also, in the above description, an embodiment in which the motor 40 is a three-phase motor is described, but the disclosure is not limited thereto. In another embodiment, for example, the motor 40 may be a single-phase motor, or a multi-phase motor different from the three-phase motor. Also, the embodiments described above may be appropriately combined.

The washing machine according to an embodiment of the disclosure includes: a fixed tub (3); a rotating tub (4) which is rotatably accommodated in the fixed tub and into which laundry is loaded; a drain mechanism (6) configured to discharge water collected in the fixed tub; a driving unit (10) including a clutch (60) switchable to a first mode in which a rotational force of a motor (40) is transferred to the rotating tub via a reducer (50) and a second mode in which the rotational force of the motor is transferred to the rotating tub without being through the reducer; and a controller (15) including a processor configured to control a driving operation of a washing machine, where the driving operation includes a first process and a second process including a dewatering process. In such an embodiment, the controller is further configured to, in the first process before the second process, set the clutch to the first mode and control the motor in a way such that a rotation speed of the rotating tub is a first rotation speed (R1), which is greater than or equal to a certain rotation speed (Rx) set to generate a centrifugal force to make the laundry stuck to an internal wall of the rotating tub, and in the second process, control the drain mechanism in a way such that water collected in the fixed tub is discharged, set the clutch to the second mode, and control the motor in a way such that the rotation speed of the rotating tub is a second rotation speed (R2) greater than the first rotation speed.

According to an embodiment, the controller is configured to control the drain mechanism in a way such that the water collected in the fixed tub is discharged in the first process.

According to an embodiment, the second process may start after a first processing time, which is set in advance, elapses from the first process.

According to an embodiment, the first processing time may be determined based on a load on the rotating tub.

According to an embodiment, the controller may be configured to, in a final stage of the first process, control the drain mechanism in a way such that the water collected in the fixed tub is drained, and measure the load on the rotating tub after an drainage from the fixed tub.

According to an embodiment, a rotating direction of the rotation tub when starting a rotation in the second process may be a reverse rotation direction of the rotating direction of the rotating tub when finishing the rotation in the first process.

According to an embodiment, the first rotation speed may be different from a resonant rotation speed corresponding to a resonant frequency of the washing machine.

According to an embodiment, the first process may include a disentangling process.

According to an embodiment, the controller, before performing the disentangling process, may be configured to measure the load on the rotating tub and determine whether the disentangling process is to be performed based on the measured load.

According to an embodiment, when the measured load value exceeds a certain threshold value, the controller may be configured to control the clutch and the motor in a way such that the disentangling process is performed.

According to an embodiment, the controller may be configured to control the drain mechanism so that the water collected in the fixed tub is drained before measuring the load on the rotating tub.

According to an embodiment, in the disentangling process, the controller may be configured to repeatedly drive the motor in a forward rotation direction and a backward rotation direction.

According to an embodiment, the dewatering process may include a preliminary dewatering process and a main dewatering process that are sequentially performed.

According to an embodiment, the controller may be configured to set the clutch to the first mode and control the motor in a way such that the rotation speed of the rotating tub is the first rotation speed in the preliminary dewatering process, and control the drain mechanism so that the water collected in the fixed tub is discharged, set the clutch to the second mode, and control the motor in a way such that the rotation speed of the rotating tub is the second rotation speed in the main dewatering process.

According to an embodiment, the controller may be configured to measure the load on the rotating tub, when the measured load value exceeds a certain threshold value, control the clutch and the motor so that the preliminary dewatering process is performed, and when the measured load value does not exceed the certain threshold value, control the clutch and the motor in a way such that the main dewatering process is performed.

According to the embodiments of the washing machine, the second process may start after reducing the load to the rotating tub in the first process, and thus, the torque required to rotate the rotating tub in the second process in which the dewatering process is performed may be reduced.

The invention should not be construed as being limited to the embodiments set forth herein. Rather, these embodiments are provided so that this disclosure will be thorough and complete and will fully convey the concept of the invention to those skilled in the art.

While the invention has been particularly shown and described with reference to embodiments thereof, it will be understood by those of ordinary skill in the art that various changes in form and details may be made therein without departing from the spirit or scope of the invention as defined by the following claims.

What is claimed is:

1. A washing machine comprising:

a fixed tub;

a rotating tub which is rotatably accommodated in the fixed tub and into which laundry is inserted;

a drain mechanism configured to discharge water collected in the fixed tub;

a driving unit including a clutch switchable to a first mode in which a rotational force of a motor is transferred to the rotating tub via a reducer and a second mode in which the rotational force of the motor is transferred to the rotating tub without being through the reducer; and a controller including a processor configured to control a driving operation of a washing machine, wherein the driving operation includes a first process and a second process including a dewatering process, wherein the controller is further configured to, in the first process before the second process, set the clutch to the first mode and control the motor in a way such that a rotation speed of the rotating tub is a first rotation speed, which is greater than or equal to a certain rotation speed set to generate a centrifugal force to make the laundry stuck to an internal wall of the rotating tub, and in the second process, control the drain mechanism in a way such that water collected in the fixed tub is discharged, set the clutch to the second mode, and control the motor in a way such that the rotation speed of the rotating tub is a second rotation speed, which is greater than the first rotation speed.

2. The washing machine of claim 1, wherein the controller is further configured to control the drain mechanism in a way such that the water collected in the fixed tub is discharged in the first process.

3. The washing machine of claim 1, wherein the second process starts after a first processing time, which is set in advance, elapses from the first process.

4. The washing machine of claim 3, wherein the first processing time is determined based on a load on the rotating tub.

5. The washing machine of claim 1, wherein the controller is further configured to, in a final stage of the first process, control the drain mechanism in a way such that the water collected in the fixed tub is drained, and to measure a load on the rotating tub after an drainage from the fixed tub.

6. The washing machine of claim 1, wherein a rotating direction of the rotation tub when starting a rotation in the second process is a reverse rotation direction of a rotating direction of the rotating tub when finishing the rotation in the first process.

7. The washing machine of claim 1, wherein the first rotation speed is different from a resonant rotation speed corresponding to a resonant frequency of the washing machine.

8. The washing machine of claim 1, wherein the first process includes a disentangling process.

9. The washing machine of claim 8, wherein the controller, before performing the disentangling process, is further configured to measure a load on the rotating tub and determine whether the disentangling process is to be performed based on the measured load.

10. The washing machine of claim 9, wherein, when the measured load value exceeds a certain threshold value, the controller is further configured to control the clutch and the motor in a way such that the disentangling process is performed.

11. The washing machine of claim 9, wherein the controller is further configured to control the drain mechanism in a way such that the water collected in the fixed tub is drained before measuring the load on the rotating tub.

12. The washing machine of claim 8, wherein, in the disentangling process, the controller is further configured to repeatedly drive the motor in a forward rotation direction and a backward rotation direction.

13. The washing machine of claim 1, wherein the dewatering process includes a preliminary dewatering process and a main dewatering process which are sequentially performed.

14. The washing machine of claim 13, wherein the controller is further configured to set the clutch to the first mode and control the motor in a way such that the rotation speed of the rotating tub is the first rotation speed in the preliminary dewatering process, and control the drain mechanism in a way such that the water collected in the fixed tub is discharged, set the clutch to the second mode, and control the motor in a way such that the rotation speed of the rotating tub is the second rotation speed in the main dewatering process.

15. The washing machine of claim 13, wherein the controller is further configured to measure a load on the rotating tub, when the measured load value exceeds a certain threshold value, control the clutch and the motor in a way such that the preliminary dewatering process is performed, and when the measured load value does not exceed the certain threshold value, control the clutch and the motor in a way such that the main dewatering process is performed.

* * * * *